US008347422B2

(12) United States Patent
Kalaam et al.

(10) Patent No.: US 8,347,422 B2
(45) Date of Patent: Jan. 8, 2013

(54) PROTECTIVE GARMENT

(75) Inventors: Shaik Kalaam, Ottawa (CA); Danny Crossman, Ashton (CA); Clint Alexander Hedge, Winchester (CA); Aris Makris, Ottawa (CA); Justin Myles, Carlsbad Springs (CA); Richard Jean L'Abbe, Ottawa (CA); Geoffrey Richard Fisher, Ottawa (CA); Magda Slobozianu, Ottawa (CA); Ildiko Palfy, Vars (CA); Ismail El Maach, Ottawa (CA); Amir Farshid, Ottawa (CA); Brent Almstedt, Ottawa (CA)

(73) Assignee: Allen-Vanguard Corporation, Ottawa (CA)

( * ) Notice: Subject to any disclaimer, the term of this patent is extended or adjusted under 35 U.S.C. 154(b) by 1204 days.

(21) Appl. No.: 11/813,151

(22) PCT Filed: Jan. 9, 2006

(86) PCT No.: PCT/CA2006/000015

§ 371 (c)(1),
(2), (4) Date: Nov. 13, 2007

(87) PCT Pub. No.: WO2006/072179

PCT Pub. Date: Jul. 13, 2006

(65) Prior Publication Data

US 2008/0134419 A1 Jun. 12, 2008

Related U.S. Application Data

(60) Provisional application No. 60/641,728, filed on Jan. 7, 2005.

(51) Int. Cl.
*A41D 13/00* (2006.01)

(52) U.S. Cl. ..... 2/463; 2/2.5; 2/79; 2/96

(58) Field of Classification Search ..... 2/2.5, 456, 2/93, 79, 461, 98, 468, 81, 102, 563, 459
See application file for complete search history.

(56) References Cited

U.S. PATENT DOCUMENTS 808,543 A * 12/1905 Horak ..... 2/91

(Continued)

FOREIGN PATENT DOCUMENTS

CA 2205602 5/1996

(Continued)

OTHER PUBLICATIONS

International Search Report; PCT/CA2006/000015; E. Breton; May 1, 2006.

*Primary Examiner* — Shelley Self
*Assistant Examiner* — Richale Quinn
(74) *Attorney, Agent, or Firm* — McMillan LLP

(57) ABSTRACT

A protective garment is provided and includes a jacket having various releasably mounted protective components. The jacket includes a protective collar of ballistic resistant fabric for protecting the neck of a wearer and has front and rear portions which are releasably connected together at opposed side portions of the collar so that the front and rear portions can fold down when not in use. A protective plate is releasably fastened to the front of the jacket and the fastening mechanism allows the plate to be held in a number of different vertical positions. The jacket also includes a rear pocket for housing a rear protective plate. The sleeves of the jacket include a sleeve extension which is slideably mounted to the main sleeve to vary its effective length.

8 Claims, 22 Drawing Sheets

U.S. PATENT DOCUMENTS

| | | | | | |
|---|---|---|---|---|---|
| 2,239,223 | A | * | 4/1941 | Gilman | 2/456 |
| 2,507,322 | A | * | 5/1950 | Smith | 2/97 |
| 2,559,226 | A | * | 7/1951 | Richardson | 2/133 |
| 3,130,414 | A | * | 4/1964 | Bailey et al. | 2/2.5 |
| 3,231,899 | A | * | 2/1966 | Seidel et al. | 2/93 |
| 3,452,362 | A | * | 7/1969 | Korolick et al. | 2/2.5 |
| 3,557,384 | A | * | 1/1971 | Barron et al. | 2/2.5 |
| 3,805,295 | A | * | 4/1974 | Garcia | 2/79 |
| 3,833,938 | A | * | 9/1974 | Shweid | 2/96 |
| 3,878,561 | A | * | 4/1975 | Winiecki | 2/461 |
| 3,891,996 | A | * | 7/1975 | Leach et al. | 2/2.5 |
| D245,731 | S | | 9/1977 | Bargsten | |
| 4,287,607 | A | * | 9/1981 | Leach | 2/2.5 |
| 4,467,476 | A | * | 8/1984 | Herbert | 2/2.5 |
| 4,485,491 | A | * | 12/1984 | Rasmussen | 2/2.5 |
| 4,497,069 | A | | 2/1985 | Braunhut | |
| H7 | H | * | 1/1986 | Martone | 2/2.5 |
| 4,590,622 | A | * | 5/1986 | Wolfe et al. | 2/462 |
| 4,774,724 | A | * | 10/1988 | Sacks | 2/2.5 |
| 4,881,529 | A | * | 11/1989 | Santos | 2/468 |
| 5,005,374 | A | * | 4/1991 | Spitler | 62/259.3 |
| 5,060,314 | A | * | 10/1991 | Lewis | 2/2.5 |
| 5,153,941 | A | * | 10/1992 | Grilliot et al. | 2/98 |
| 5,189,737 | A | * | 3/1993 | Ribicic | 2/93 |
| D340,542 | S | | 10/1993 | Marlowe | |
| 5,431,318 | A | * | 7/1995 | Garcia | 224/192 |
| 5,638,547 | A | * | 6/1997 | Hewitt | 2/81 |
| 5,685,015 | A | * | 11/1997 | Aldridge | 2/81 |
| 5,946,719 | A | * | 9/1999 | Crupi et al. | 2/6.5 |
| 5,966,747 | A | * | 10/1999 | Crupi et al. | 2/466 |
| 5,991,924 | A | * | 11/1999 | Grilliot et al. | 2/98 |
| D429,384 | S | | 8/2000 | Crupi et al. | |
| 6,098,196 | A | * | 8/2000 | Logan | 2/2.5 |
| D435,697 | S | | 12/2000 | James et al. | |
| 6,195,802 | B1 | * | 3/2001 | Armellino | 2/102 |
| D441,917 | S | | 5/2001 | L'Abbe et al. | |
| 6,360,372 | B2 | | 3/2002 | Oster | |
| D475,812 | S | | 6/2003 | Kalaam et al. | |
| D476,138 | S | | 6/2003 | Lehy et al. | |
| 6,698,024 | B2 | * | 3/2004 | Graves et al. | 2/2.5 |
| 6,934,970 | B1 | * | 8/2005 | Watkins et al. | 2/96 |
| 6,961,957 | B2 | | 11/2005 | Carlson | |
| 7,003,812 | B1 | * | 2/2006 | Lewis et al. | 2/468 |
| 2003/0066116 | A1 | | 4/2003 | Graves et al. | |
| 2008/0134419 | A1 | * | 6/2008 | Kalaam et al. | 2/463 |
| 2011/0004968 | A1 | * | 1/2011 | Morgan | 2/2.5 |
| 2011/0010829 | A1 | * | 1/2011 | Norman | 2/459 |

FOREIGN PATENT DOCUMENTS

| | | |
|---|---|---|
| CA | 2236399 | 10/1999 |
| CA | 2241747 | 2/2000 |
| CA | 2505602 | 11/2004 |
| EP | 0 334 145 | 9/1989 |
| GB | 3001462 | 2/2002 |

* cited by examiner

PROTECTIVE GARMENT

CROSS-REFERENCE TO RELATED APPLICATIONS

This is a U.S. National Phase application from International Application No. PCT/CA2006/000015 filed on 9 Jan. 2006, which claims priority from U.S. Provisional Application No. 60/641,728 filed on 7 Jan. 2005.

FIELD OF THE INVENTION

The present invention relates to protective garments for protecting various parts of a body, including, but not limited to garments for protecting the upper part of a body from explosive blasts.

BACKGROUND OF THE INVENTION

Military personnel are often equipped with ballistic resistant vests to protect the torso region from bullets and shrapnel. These vests, of which the "Interceptor Vest" is one example, typically have front and back ballistic resistant plates formed of a ceramic material to break up and absorb the impact from ballistic projectiles and to prevent them from penetrating the thoracic cavity and damaging vital organs. The vests are sleeveless and may be worn under a standard military jacket.

When operating in a war zone or other hazardous situation, military personnel can be exposed to a variety of different threats. Roadside bombs constitute a particularly insidious and hazardous threat in modern day warfare. The bombs are often well concealed and may be triggered automatically by the target vehicle as it draws up alongside the bomb. The bomb blast, including the overpressure wave and blast fragments are therefore directed towards the side of the vehicle. Some military vehicles have a cupola which provides a raised observation and machine gun platform in the roof of the vehicle so that a soldiers head and torso is typically positioned above roof level. Typically, no additional protection is provided on the vehicle so that the soldier's upper body is completely exposed and the soldier has to rely upon what he is wearing for protection. Unfortunately, the interceptor vest or any other known military equipment does not provide adequate protection against blasts directed to the side of military personnel, for example, from roadside bombs.

Embodiments of the present invention provide a system for protecting military personnel from explosive blasts from the side and also from other directions.

SUMMARY OF THE INVENTION

According to one aspect of the present invention, there is provided a protective garment comprising a torso portion and a protective collar upstanding from the torso portion, in which at least part of the protective collar comprises one or more layers of ballistic resistant material.

In one embodiment, the protective collar extends to a sufficient height to screen the neck of a wearer from an explosive blast to at least one of the side, front and back. Preferably, the protective collar completely surrounds the neck to provide protection from all directions.

In some embodiments, the collar may include a releasable fastener for releasably connecting a portion of the collar to another part of the protective garment (e.g. another collar portion) to maintain said collar in an upstanding position, and to allow said collar to be lowered when said fastener is released. For example, the collar may be attached or attachable to the front (and/or rear) of the garment, and include at least one or opposed right and left side portion(s) that can be released to allow the collar to fold down towards the front (and/or rear) of the garment.

In one embodiment, the protective collar provides a sufficiently large opening to accommodate a helmet. For example, the circumference of the collar may be sufficiently large to accommodate at least a lower part of a helmet. The helmet may comprise a lower rear portion and have an open face or closed face, and the helmet may or may not have a visor. Embodiments of the collar may be capable of providing a sufficiently large inner circumference to accommodate one or more of the helmet types just described.

According to another aspect of the present invention, there is provided a protective garment comprising a torso portion having front, rear and side portions, and in which one or both side portion(s) includes a protective plate positioned to protect a side portion of a torso.

In one embodiment, the protective plate may comprise one or more layers of ballistic resistant material, and may comprise a resin based composite comprising a plurality of layers of ballistic resistant material.

Advantageously, this arrangement protects the side of the torso from explosive fragments.

In some embodiments, the protection garment includes mounting means for releasably mounting the protect plate(s) to a respective side portion.

According to another aspect of the present invention, there is provided a protective garment comprising a torso portion and at least one sleeve, in which the sleeve comprises one or more layers of ballistic resistant material. Advantageously, the ballistic resistant material provides protection from explosive fragments directed to the side of an operative.

According to another aspect of the present invention, there is provided a protective jacket comprising a torso portion and a collar, the collar having a front portion and a rear portion, and fastening means for releasably attaching the front portion to the rear portion at a side of said collar.

According to a further aspect of the present invention, there is provided a protective garment comprising a torso portion having front, back and side portions, and a blast plate holder separate from the torso portion and fastening means for releasably attaching the holder to the front of said torso portion.

According to yet another aspect of the present invention, there is provided a protective garment comprising a torso portion and at least one sleeve, in which the sleeve comprises a first part which is connected to the torso portion and a second part which is slideably connected to said first part.

In this arrangement, the slideable connection allows the sleeve to be extended and retracted to vary the length of the sleeve, for example to fit an individual wearer or to increase/decrease arm coverage.

Some embodiments include one or more guides for guiding the sliding movement between the parts.

According to a further aspect of the present invention, there is provided a protective garment comprising a torso portion and at least one sleeve, wherein said sleeve is openable along a portion which extends from below the elbow to at least a position within an upper arm portion of said sleeve.

In some embodiment, the sleeve is continuously openable along said portion. Some embodiments include fastening means for selectively closing and opening said portion.

According to a further aspect of the present invention, there is provided a groin protector having a front portion, a rear portion, and first and second leg openings and fastening means on at least one side of the protector for releasably fastening a waist region of the front portion to a waist region of the rear portion, and a pull member attached to the front portion for manually releasing the front portion from the rear portion.

Advantageously, the pull member allows the groin protector to be quickly unfastened and removed.

According to a further aspect of the present invention, there is provided a protective skirt for a helmet, the skirt having a rear portion for protecting the neck of a wearer and opposed side portions for protecting the sides of the head of a wearer.

In some embodiments, a helmet is selected for use with the skirt, and the skirt extends, beyond at least a portion of a peripheral edge of the helmet to protect a wearer in a region over which the helmet does not extend.

In one embodiment, the protective skirt further comprises at least one front portion extending from a side portion for protecting a side of the face of a wearer.

In some embodiments, the skirt includes fastening means for releasably fastening the skirt to a helmet.

In some embodiments, the protective skirt comprises one or more layers of ballistic resistant or high tensile strength fabric.

According to a further aspect of the present invention, there is provided a protective garment comprising a torso portion and a protective collar for extending upwardly from the torso portion and fastening means for releasably connecting the collar to said torso portion.

According to a further aspect of the present invention, there is provided a protective garment comprising any one or more of the features disclosed herein or their equivalent.

In one embodiment, the protective garment comprises a jacket which serves as a shell or support to accommodate and retain one or more various body protective elements. The jacket may include retaining means for removeably retaining one or more protective elements thereon. For example, the jacket may include a detachable protective collar for protecting the neck of a wearer from explosive fragments or from other threats or impacts. Each sleeve of the jacket may be adapted to hold one or more protective element(s) for protecting the arms of a wearer. An example of a protective element for the arm comprises one or more layers of ballistic resistant fabric which may be mounted to the sleeve. For example, the ballistic resistant material can be formed as an insert for inserting into a pocket in the sleeve, either from the outside or from the inside thereof. Another arm protective element may comprise a protective plate for protecting the arm against high velocity fragments (and/or blunt impacts). The protective plate may comprise a plurality of layers of ballistic resistant material, and in one embodiment, comprises a resin based composite comprising a plurality of layers of ballistic resistant material (e.g. fabric). The plates may be removably mounted on the arm and in one embodiment are mounted within a pocket within the arm. Protective plates may be provided for the upper arm and/or lower arm. In other embodiments, one or more protective arm elements may be worn/mounted externally of the sleeve.

In one advantageous embodiment, the sleeves have a retractable sleeve extension so that the sleeve may be extended to provide protection to a portion of the lower arm, for example the cuff and wrist regions. In one embodiment, the sleeve extension may be slidably mounted to the main sleeve.

Another protective element that may be provided for the jacket comprises a front blast protector which includes one or more overpressure plates and a holder therefor which can be detachably mounted to the front of the jacket. The holder and jacket may comprise fastening means which allows the holder to be secured to the jacket at various different vertical positions relative to the jacket.

Another protective component that may be provided for use with the jacket is a rear overpressure plate which may be detachably mountable to the rear of the jacket, for example held within a pocket provided on the rear of the jacket, or releasably mounted by one or more fasteners.

The various protective components may be added or removed, as necessary depending on the prevailing threat and level of protection required which significantly improves the versatility of the protective equipment.

According to another aspect of the invention, there is provided a protective collar comprising a front portion and left and right portions for extending around at least part of a wearer's neck, each side portion having a free end, retaining means for retaining the ends of the collar such that the collar can remain in place about a wearer's neck when in use, and attachment means for attaching the front of the collar to a means for supporting the collar on the wearer when the free ends are released from the retaining means.

According to another aspect of the invention, there is provided a protective system for protecting a wearer comprising left and right shoulder protector plates for placing on a wearer's shoulders, a front torso plate, means for releasably coupling the front torso plate to at least one of said shoulder plates, a rear torso plate and means for releasably coupling the rear torso plate to at least one of (1) the front torso plate and (2) one or both of said shoulder plate(s).

According to another aspect of the invention, there is provided a protective system for protecting a wearer comprising a garment for at least partially covering an upper body portion of a wearer, left and right shoulder plates for placing on a wearer's shoulders, a front torso plate, means for releasably coupling the front torso plate to at least one of the garment and at least one shoulder plate, a rear torso plate and means for releasably coupling the rear torso plate to at least one of (a) the garment, (b) at least one shoulder plate and (c) the front plate.

According to another aspect of the invention, there is provided a protective system for protecting a wearer comprising left and right shoulder plates for placing on a wearer's shoulders, a front torso plate and means for releasably coupling the front torso plate to one or both shoulder plate(s).

According to another aspect of the invention, there is provided a protective system for protecting a wearer comprising left and right shoulder plates for placing on a wearer's shoulders, a rear torso plate and means for releasably coupling the rear torso plate to one or both of the left and right shoulder plates.

According to another aspect of the invention, there is provided a protective system for protecting a wearer comprising a front torso plate and a rear torso plate and means for releasably coupling the front torso plate to the rear torso plate.

According to another aspect of the invention, there is provided protective pants having right and left leggings and at least one strap means connecting said left and right leggings in a groin region of said pants.

According to another aspect of the invention, there is provided protective pants comprising first and second leggings and wherein at least one legging can be opened along at least a major portion of its length, for example at the front, side or rear thereof.

According to another aspect of the invention, there is provided protective pants having first and second leggings and at least one of a thigh protector plate and a hip protector plate, optionally releasably connected thereto, by means of a pocket in said pants for receiving a plate.

According to another aspect of the invention, there is provided a garment comprising a fastening system for fastening an object thereto, the fastening system comprising a web/strap attached to said garment and having a free portion including a free end, fastening means for releasably fastening the free portion to the garment, the object having an aperture for receiving said free end such that said web/strap can pass through the aperture and be fastened to the garment by said fastening means, and securing means for securing another portion of said object against said garment such that said fastening means is substantially covered by said object.

BRIEF DESCRIPTION OF THE DRAWINGS

Examples of embodiments of the present invention will now be described with reference to the drawings, in which.

DETAILED DESCRIPTION OF EMBODIMENTS

Figure 1:
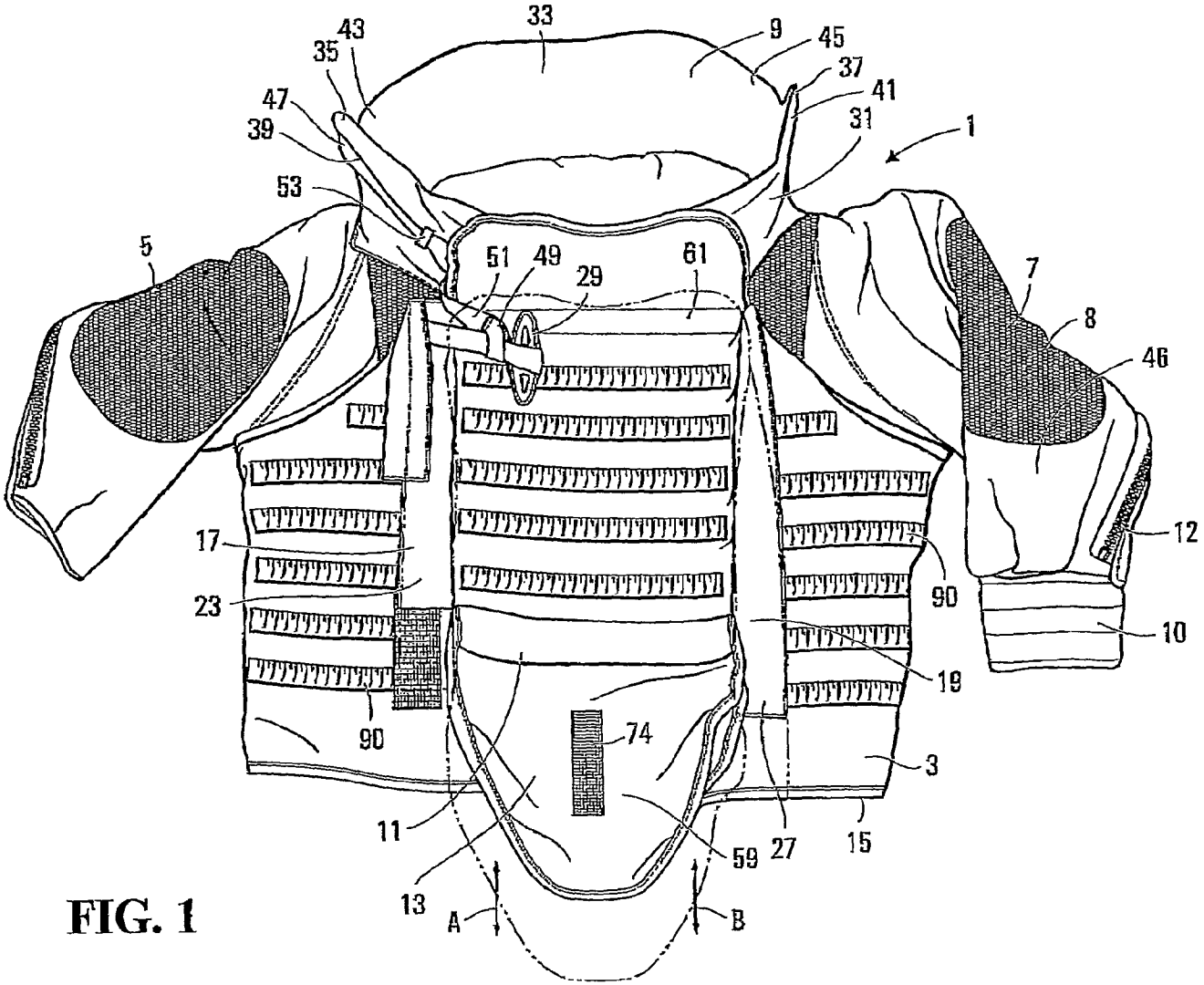
FIG. 1 shows a front view of a protective jacket according to an embodiment of the present invention in the closed position.

Referring to FIG. 1, a protective jacket according to an embodiment of the present invention and generally shown at 1 comprises a torso portion 3, right and left sleeves 5, 7 extending from the torso portion and a protective collar 9 extending upwardly from the torso portion.

Figure 2:
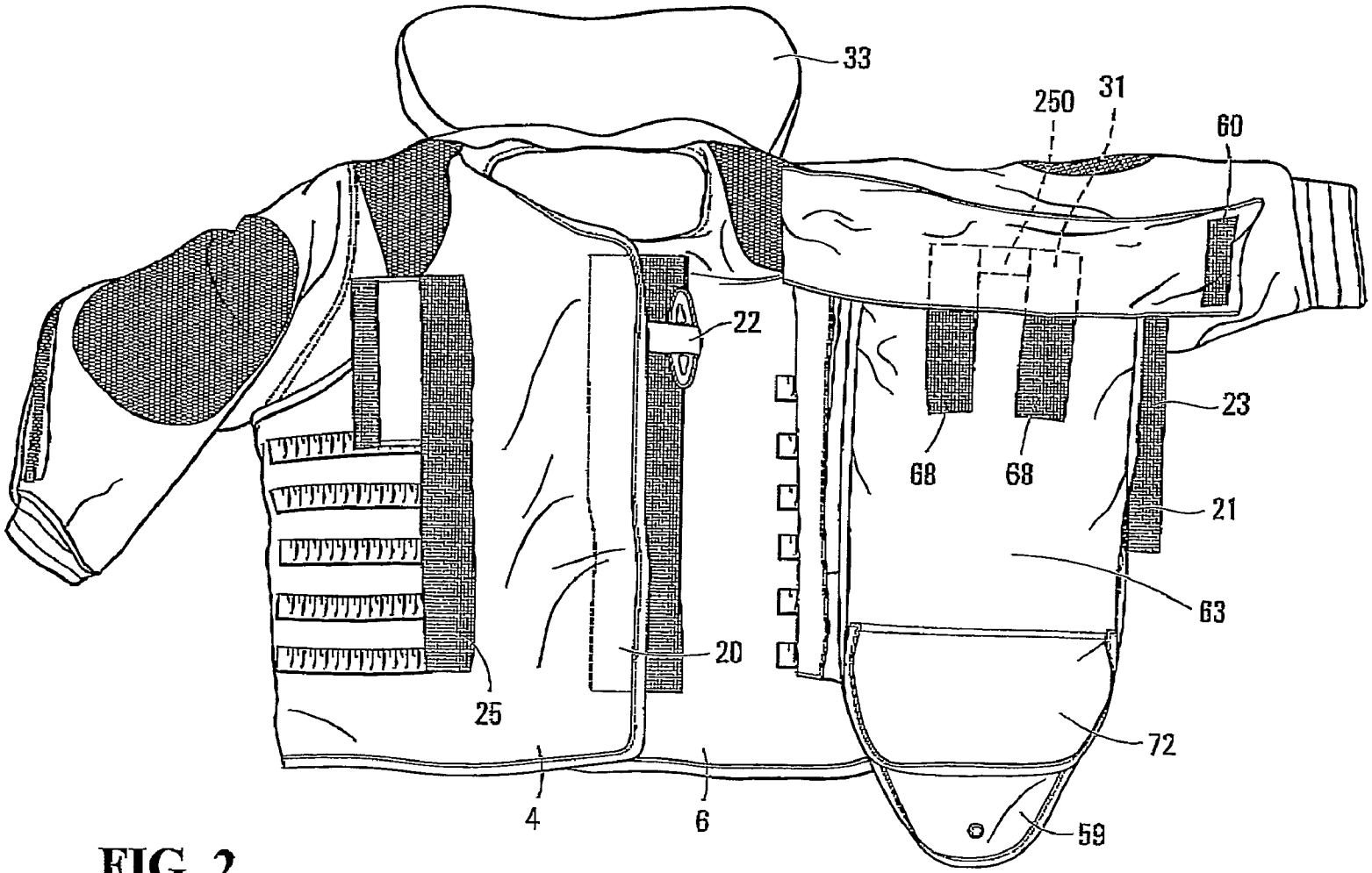
FIG. 2 shows a front view of the protective jacket of FIG. 1 in the semi-open position.

The jacket further comprises a front blast protector 11 comprising a blast plate holder 13 for holding one or more blast (or over pressure) plates therein (not shown). In this embodiment, the blast plate holder has a length which is sufficient to extend from a neck portion to the groin portion of a wearer such that one or more blast plates mounted therein can provide continuous over blast protection between these regions. The blast plate holder is attached to the front of the jacket by right and left fasteners 17, 19 on either side thereof. In this embodiment, the left hand fastener 19 hingedly couples the blast plate holder to the jacket and allows the blast plate holder to swing open when the right hand fastener 17 is released, as shown in FIG. 2. The right hand fastener in this embodiment comprises a quick release fastening system, for example, a hook and loop fastening system such as Velcro™, so that the over-blast protector can be released and the jacket opened simply by pulling on the blast plate holder. In this example, the right hand fastening system comprises a flap 21 having Velcro™ 23 on the inside thereof as shown in FIG. 2 and a complementary Velcro™ strip 25 on the right hand side of the jacket. In other embodiments, any other type of fastener or fastening system may be used.

The left hand fastener 19 may be arranged to allow the blast plate holder to be completely removed from the front of the jacket so that the jacket can be worn without the blast plate when it is not required. In this example, the left hand fastener 19 comprises a flap 27 disposed along the left hand side of the blast plate holder 11 and which has a hook and loop fastener (e.g. Velcro) on the inside thereof (not shown). A complementary hook and loop (e.g. Velcro) fastener (not shown) is secured to the left hand portion of the jacket to enable the left hand fastener of the blast plate holder to be removably secured thereto.

Advantageously, the left and right blast plate fasteners may be arranged to permit the blast plate holder to be secured to the front of the jacket in a variety of different raised and lowered positions, as indicated by the arrows A and B. Hook and loop type (e.g. Velcro) fasteners are particularly suitable for this purpose, although other fasteners may be used such as buttons and eyes or snap connectors, such as popperstuds, for example. The fastenings on either side of the blast protector may also allow the blast protector to be opened from either the left side or the right side. In other embodiments, the fastening system described above may be reversed so that the right hand side elements are transposed to the left and vice versa, to allow the jacket normally to be opened from the left hand side.

One or more holders 90 for holding munitions such as bullets or other object(s) may be provided on the jacket, and in one embodiment may be formed by strips of material stitched at spaced intervals to the jacket to form holders between adjacent stitches.

Referring to FIG. 2, the jacket comprises right and left portions 4, 6, which fasten together to close the front of the jacket by means of a fastener, such as a hook and loop type fastener (e.g. Velcro) 20, although any other type of fastener may be used. The right hand portion 4, which overlaps the left hand portion may be provided with a pull member 22 to facilitate opening the jacket with one hand. The width of the jacket fastener 20 may be sufficient to allow the overlap of the front portions of the jacket to be varied to fit different sized personnel.

In this arrangement, the jacket may be opened in a two step procedure, with the wearer's left hand opening the over-blast protector and the wearer's right hand opening the right side 4 of the jacket.

In other embodiments, the over-blast protector may be opened from the left side and the left side of the jacket may be arranged to overlap the right hand side, when fastened together, so that the two step procedure is performed by opening the over-blast protector with the right hand and the left side of the jacket with the left hand.

Referring to FIGS. 1 and 2, the collar 9 comprises a front portion 31 and a rear portion 33, in which the front portion is releasably attached to the rear portion at a side 35 of the collar. Although the front and rear portions may comprise a single piece, in this embodiment, the front portion is a separate piece from the rear portion and is also releasably attached to the rear portion at the other side 37 of the collar, for reasons described below.

In this embodiment, the front portion of the collar can be released from the rear portion thereof by pulling the front portion towards the front of the jacket and in one embodiment, the front portion may be secured to the rear portion by a releasable fastener, for example by a hook and loop type fastener such as Velcro. To facilitate its release from the rear portion, one or both ends 39, 41 of the front portion may overlap corresponding end portions 43, 45 of the rear collar portion.

To facilitate opening the jacket, a pull member 29 such as a toggle (or other pull handle) may be provided at one (or both) side(s) of the over blast protector 11 which can be readily grasped by one hand (in this case the left hand) and pulled by the (left) arm. In this embodiment, the pull handle is positioned at an upper portion of the over blast protector so that the natural and convenient motion of pulling the arm downwards and away from the jacket readily releases the over blast protector from the front of the jacket.

Advantageously, a pull member 47, for example a strap, is secured to an end 39 of the front portion of the collar to facilitate its release from the rear portion thereof. In one embodiment, the pull member (e.g. strap) is couplable to the pull member 29 of the over blast protector 11, so that on pulling the latter pull member, both the front portion of the collar and over blast protector are released at the same time. In the present embodiment, the strap attached to the front portion of the collar has a loop 49 at its free end 51, which conveniently loops over the pull handle 29 of the over blast protector 11.

Figure 3A:
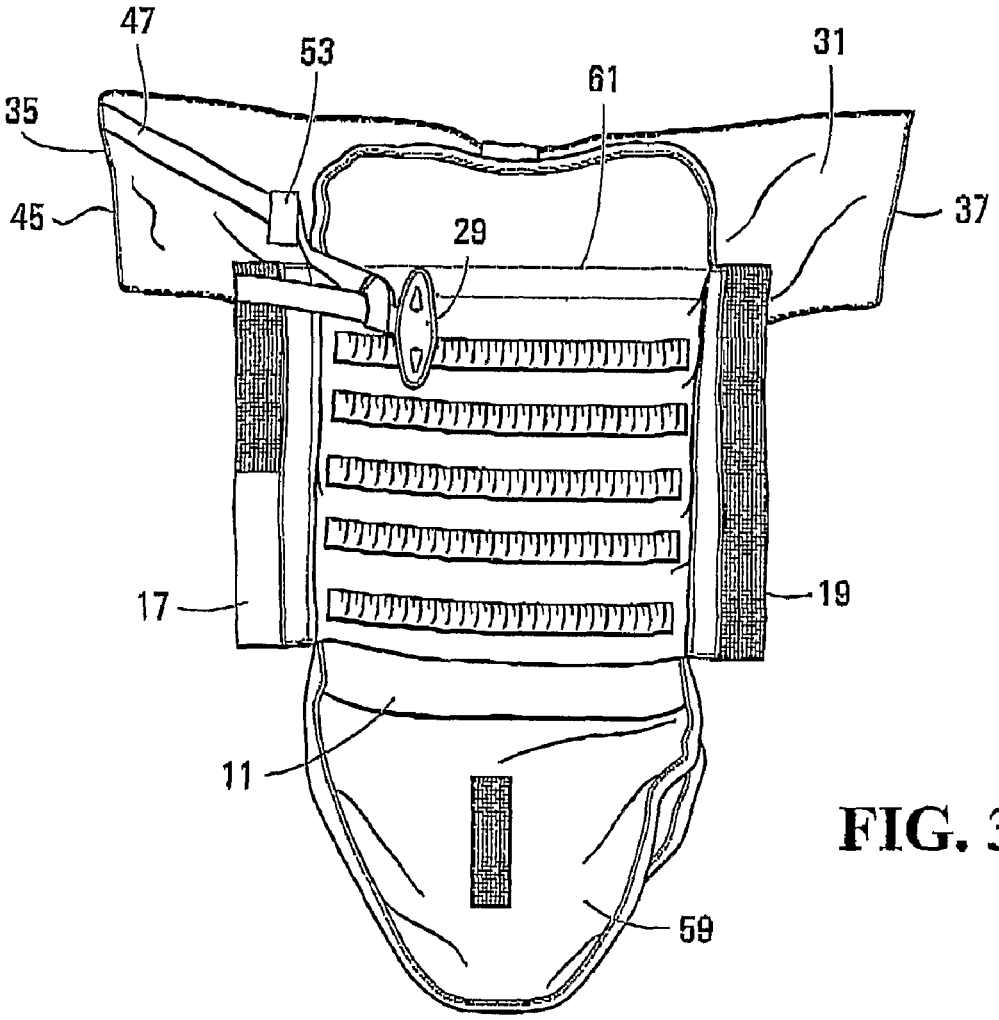
FIG. 3A shows a front view of a front blast plate holder and front collar part according to an embodiment of the present invention.
Figure 3B:
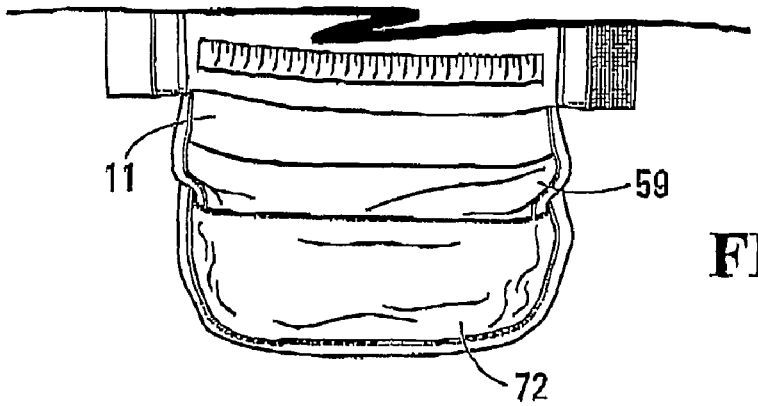
FIG. 3B shows a front view of the front blast plate holder shown in FIG. 3A with the lower portion thereof raised, folded and inserted into a pocket.

FIG. 2 shows the over blast protector and front portion of the collar released from the right hand side of the jacket, and FIGS. 3A and 3B show the over blast protector and front collar portion completely released from the jacket. In this embodiment, the right hand side of the front portion of the collar includes an eye or loop 53 through which the strap 47 passes and which tends to cause the end 47 of the front collar portion to bend away from the end of the rear collar portion, so that its release starts from the edge 45 and progresses inwards.

Figure 4A:
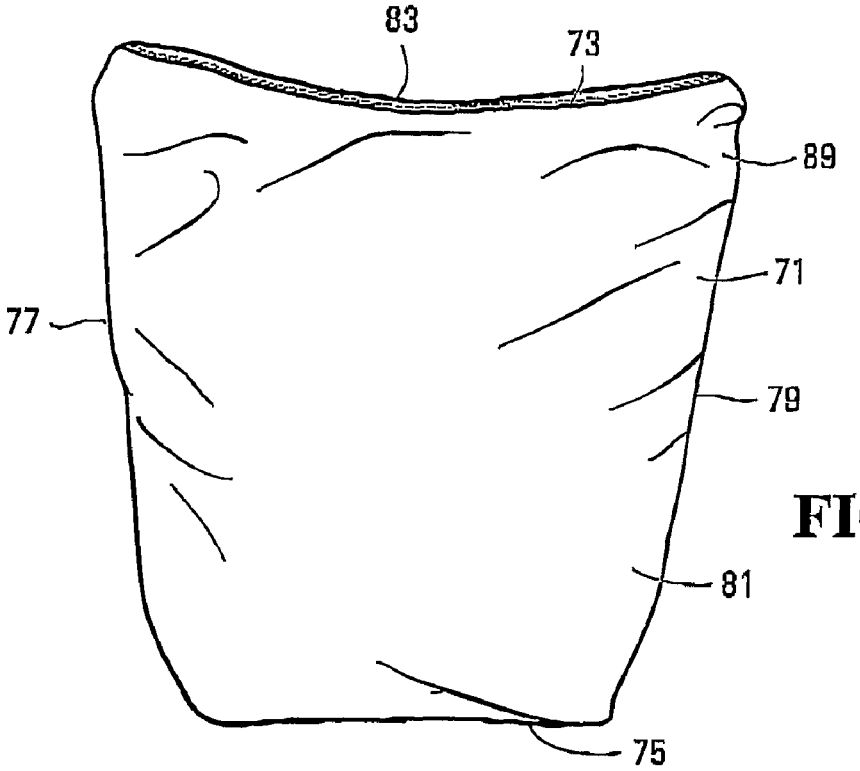
FIG. 4A shows a front view of a front blast plate according to an embodiment of the present invention.
Figure 4C:
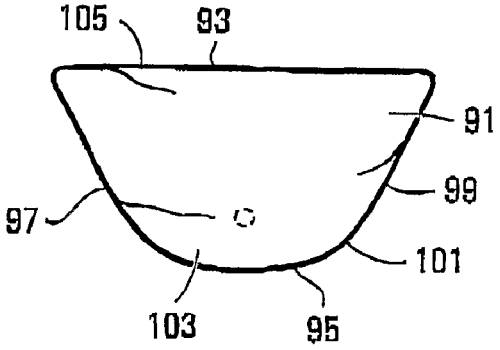
FIG. 4C shows a front view of a lower blast plate according to an embodiment of the present invention.
Figure 4B:
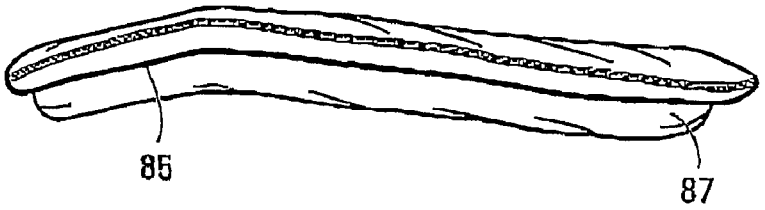
FIG. 4B shows a side view of the blast plate shown in FIG. 4A.

FIGS. 4A and 4B show an example of a front torso blast plate for protecting the front torso region, and FIG. 4C shows an example of a lower blast plate for use with the blast plate holder for protecting a lower region, for example, the groin region of a wearer. The torso blast plate 71 has upper and lower edges 73, 75 and opposed side edges 77, 79. The plate is curved between the side edges so that the front face 81 is convex and the rear face 83 is concave to conform generally with the curvature of the human torso. As shown in FIG. 4B, a lower portion 85 of the torso plate 71 is curved inwardly relative to an upper portion 87, again to conform generally to the longitudinal curvature of a human torso and to reduce any visual obstruction to the ground which may otherwise be caused if the plate were linear in the longitudinal direction (i.e. between the upper and lower edges).

The torso plate may comprise any suitable material or combination of materials, and in one embodiment comprises an outer layer of polycarbonate (e.g. Macrolon) and an inner layer of foam. The plate may be enclosed within an external protective cover 89 which may comprise any suitable material such as nylon or other material, and may be water resistant or waterproof.

Referring to FIG. 4C, the lower blast plate 91 has an upper edge 93, a lower end 95 and opposed side edges 97, 99 and has a generally curved lower edge 101. The lower plate may be curved between the opposed side edges 97, 99 so that the front face 103 is convex and the rear face 105 is concave. The lower blast plate 91 may comprise any suitable material or combination of materials as described above in connection with the torso plate and may include a protective cover.

Returning to FIGS. 1 and 3A and B, the blast plate holder 11 comprises a front pocket 59 having an opening 61 for receiving the lower blast plate 91, and an inside pocket 63 having an opening 65 near the top (not shown) for receiving the torso blast plate 71. A flap (not shown) may be provided to close the opening 65 of the inner pocket 63. One or more fasteners, for example hook and loop type (e.g. Velcro) fasteners 68 may be provided to secure the front collar 31 to the blast plate holder. In other embodiments, the blast plate holder may have an outer pocket for the upper blast plate and an inner pocket for the inner blast plate, or both plates may be accommodated in the same pocket (either front or inner) in which case only one pocket be provided.

Referring to FIG. 3B, the blast plate holder 13 may include a lower pocket 72 for receiving the lower portion of the blast plate holder 59 when the lower blast plate is raised or removed from the holder and is not in use. Advantageously, the lower pocket 72 allows the lower portion of the holder to be neatly folded away. A fastener 74 may be provided on the lower portion 59 to secure the lower portion of the blast plate holder in the lower pocket 72 (which may have a complementary fastener therein, not shown).

Figure 5:
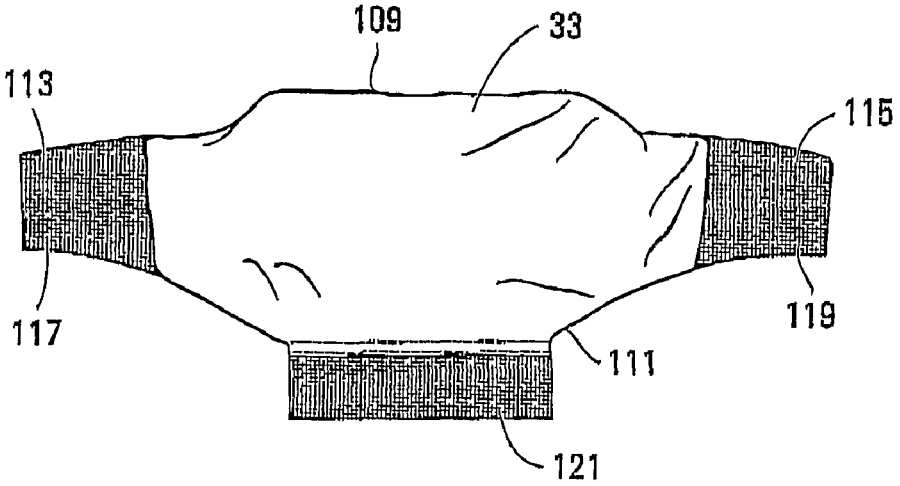
FIG. 5 shows a plan view of a rear collar part according to an embodiment of the present invention.
Figure 6:
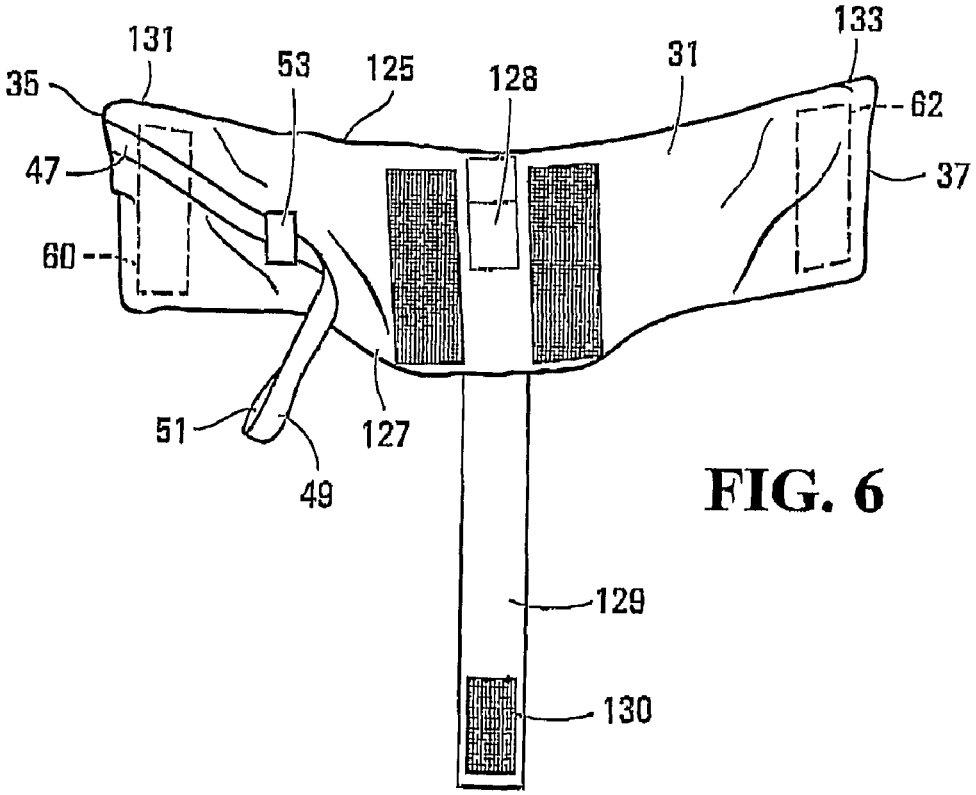
FIG. 6 shows a front view of a front collar part according to an embodiment of the present invention.

As described above, the protective collar may comprise separate front and rear portions and an example of the protective collar is shown in more detail in FIGS. 5 and 6. Referring to FIG. 5, an embodiment of a rear collar portion 33 has upper and lower edges 109, 111 and opposed side portions 113, 115. Each side portion includes a fastener 117, 119 for fastening the aide portions to <corresponding side portions of the front collar portion, and the fasteners may comprise Velcro fasteners or some other fastener.

In this embodiment, the rear collar portion 33 is detachable from the jacket and has a releasable fastener 121 positioned at its lower edge 111 which allows the rear collar portion to be detachably fastened to the jacket. In this example, the detachable fastener 121 comprises a strip which includes Velcro on at least one side thereof for attaching to complementary Velcro at the rear of the jacket. Other embodiments may have a different type of fastener for fastening the rear collar portion to a jacket.

FIG. 6 shows an example of a discreet front collar portion 31 which has opposed upper and lower edges 125, 127 and opposed side portions 35, 37. As for the rear collar portion, the front portion may be completely detachable from the jacket and has a fastener 129 for detachably fastening the front collar portion to the jacket. In this embodiment, the fastener 129 comprises a strap extending from the lower edge 127 of the front collar portion and which passes through a loop or eye 250 (FIG. 2) provided on the rear of the blast plate holder and folds over the upper edge 125 of the front collar portion and fastens onto the rear of the front collar portion, for example by means of complementary fasteners 128, 130 such as hook and loop fasteners or an other type of releasable fastener. Advantageously, the strap allows the front collar portion to be adjusted up and down relative to the jacket for comfort or another purpose.

The front collar portion also includes a pull strap 471, an eye or loop 53 and pull loop 49 at the other end thereof, as described above in connection with FIGS. 1 and 3.

In this embodiment, the inner face 131, 133 of each side 35, 37 of the front collar portion is provided with a complementary fastener 60, 62 (FIG. 6) for coupling to a corresponding fastener 177, 179 on the rear collar portions 33.

Figure 7A:
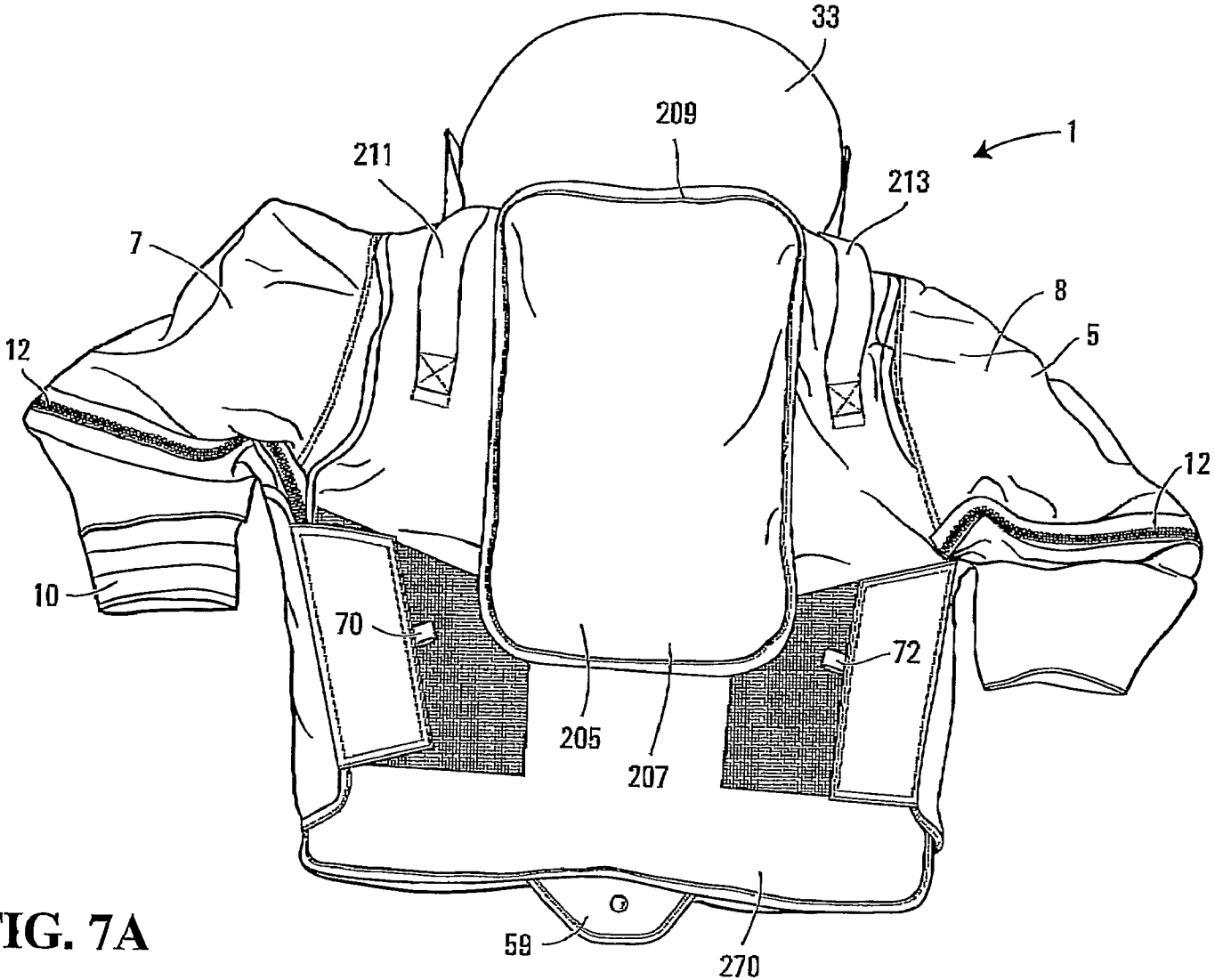
FIG. 7A shows a rear view of a protective jacket according to an embodiment of the present invention.
Figure 7B:
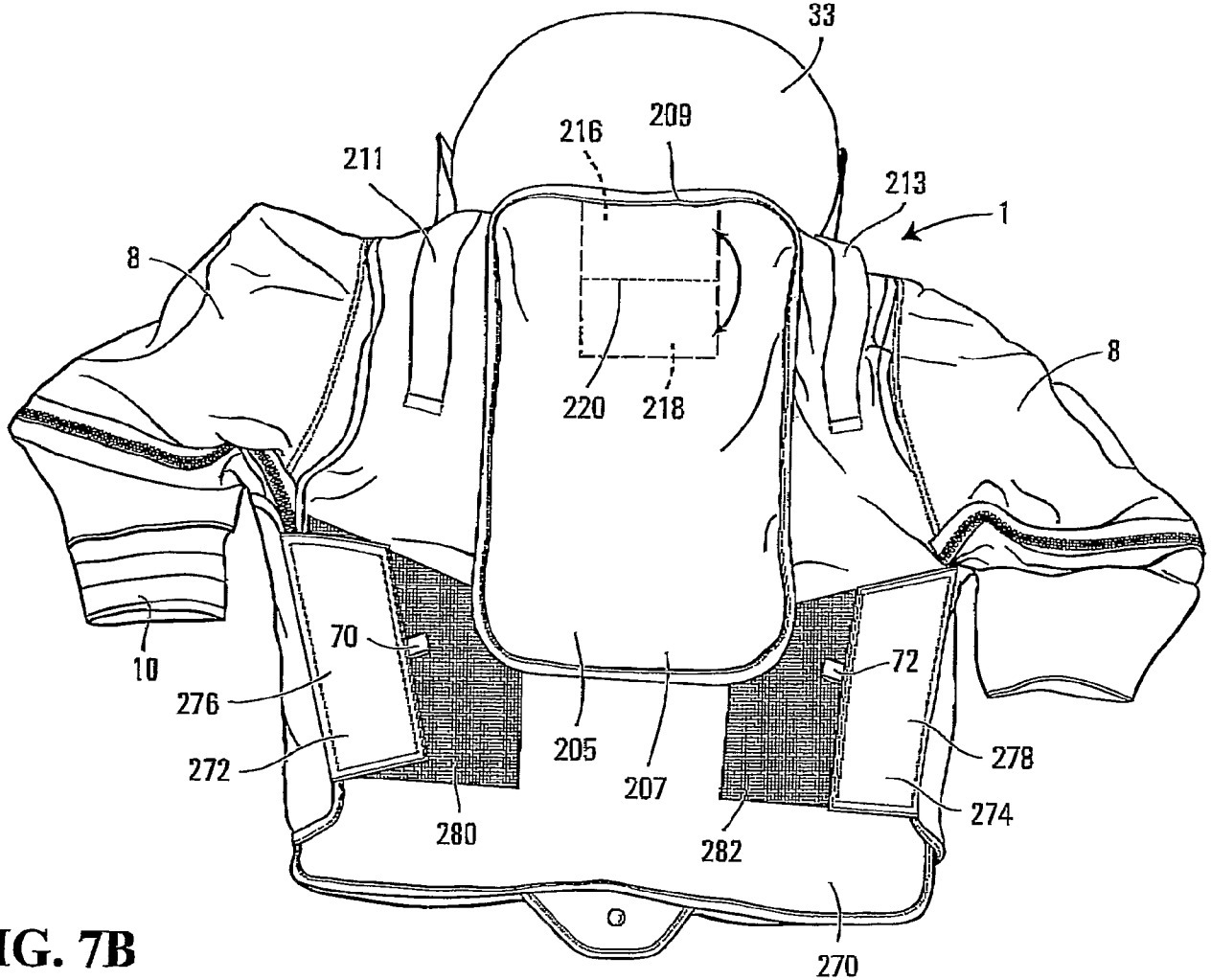
FIG. 7B shows a rear view of protective jacket according to an embodiment of the present invention.

FIGS. 7A and 7B show a rear view of an embodiment of the jacket 1 which may also be provided with a rear blast/overpressure (or other) protector 205. A mounting system may be provided for releasably mounting the rear protector plate to the jacket. In this embodiment, the jacket includes a pocket 207 secured to a middle portion of the rear of the jacket, for accommodating a rear blast plate (not shown) and includes an opening 209 for receiving the blast plate.

One or more handles 211, 213 is provided on the rear of the jacket to allow the jacket to be grasped by a third party so that the wearer can be pulled from a hazard to an area of safety, if the need arises.

In this embodiment, the lower middle portion or panel 270 of the back of the jacket is detachably secured to the lower left and right side portions 272, 274 to provide adjustment. The left and right side portions 272, 274 may include a flap 276, 278 which carries a fastener for adjustably securing to a complementary fastener 280, 282 on the rear middle jacket panel 270. Conveniently the flaps may include a pull member e.g. 70, 72, to facilitate unfastening the flap from the back portion for adjustment.

Figure 8A:
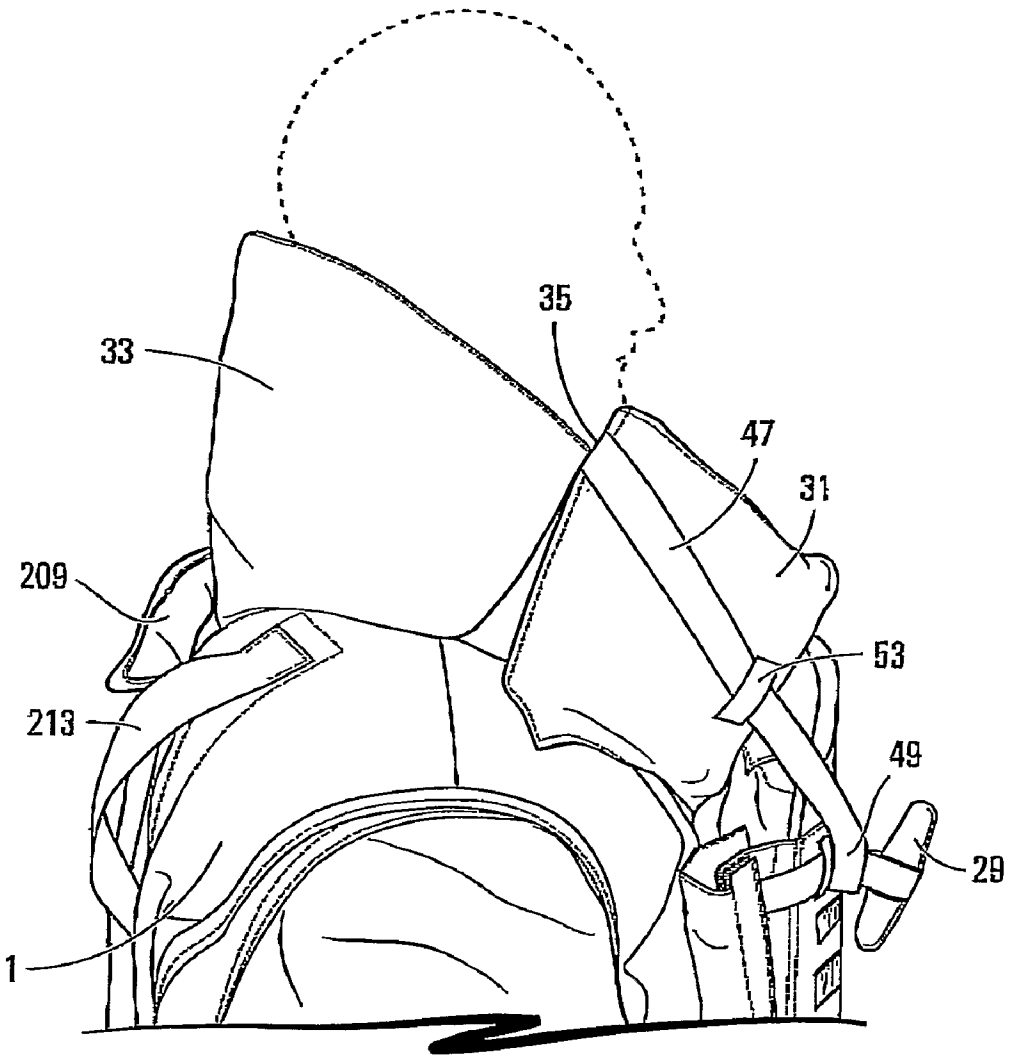
FIG. 8A shows a side view of the protective jacket shown in FIGS. 1 and 2 with the collar in the closed position.

FIG. 8A shows a side view of the protective jacket with the front and rear portions of the protective collar in the raised position. The collar preferably extends to a sufficient height to fully cover the neck of the wearer. In this embodiment, the top of the front collar is below that of the rear collar, and the collar slopes downwardly from back to front to reduce obstruction to a wearer's line of sight to the ground. At least part of the front portion may be sufficiently high in the raised position to cover a person's chin and/or jaw region when viewed from the side as shown in FIG. 8A. The rear portion of the collar is secured to the jacket by means of a fastener which may conveniently be disposed within the blast plate pocket 207 shown in FIGS. 7A and 7B and the fastener may comprise a complementary fastener to the fastener 21 on the rear portion of the collar described above in conjunction with FIG. 5. In other embodiments, any other suitable fastener(s) may be used Referring to FIG. 7B, in one embodiment, the fastener within the pocket may comprise a first contact based fastener (e.g. Velcro) 216 and a second contact based fastener 218, which can be positioned opposite each other to clamp or, sandwich the rear collar fastener therebetween. In the example shown in FIG. 7B, the second fastener 218 comprises a flap below the first fastener 216, which can be folded upwardly about the fold line 220 to lie opposite the first fastener 216, so that both fasteners fasten to opposite sides of the rear collar fastener or to each other when the rear collar is detached.

Figure 8B:
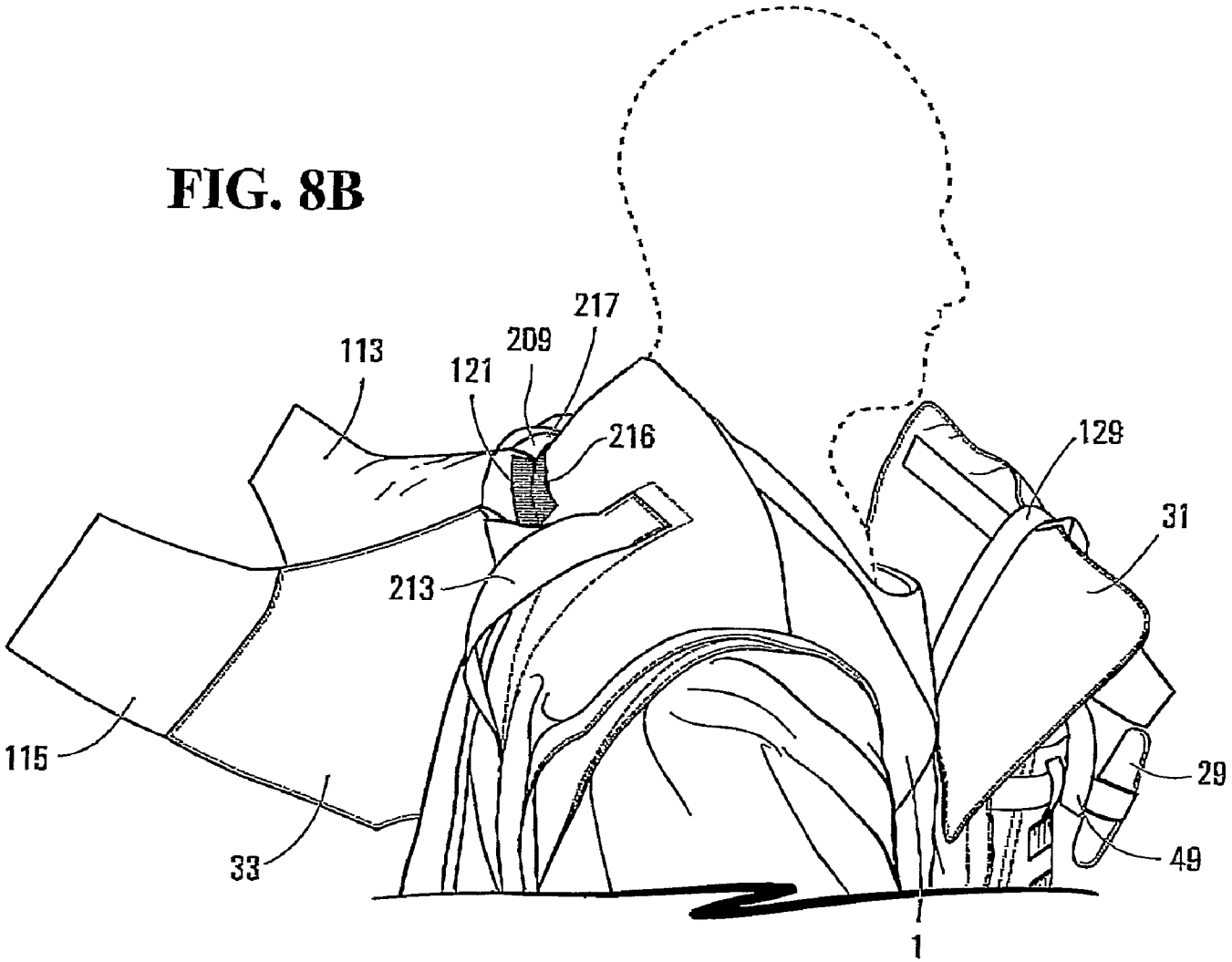
FIG. 8B shows a side view of the protective jacket shown in FIG. 8A with the collar in the open position.

FIG. 8B shows a side view of the jacket with the front collar portion detached from the rear collar portion and the front portion positioned forward and away from the wearer and the rear collar portion folded down over the rear of the jacket. Advantageously, the detachable two part collar allows the collar to be moved away from the wearer and yet still attached to the jacket, allowing the wearer greater freedom of movement when the protective collar is not in use.

Referring to FIG. 8A when the collar is in the raised position, the inner circumference of the collar may be sufficient to accommodate a helmet and helmet visor so that the lower edge of the visor lies within the circumference of the front collar portion. This feature ensures that an explosive pressure wave does not pass underneath the lower portion of the visor causing increased whiplash and possibly severe injury.

Figure 9:
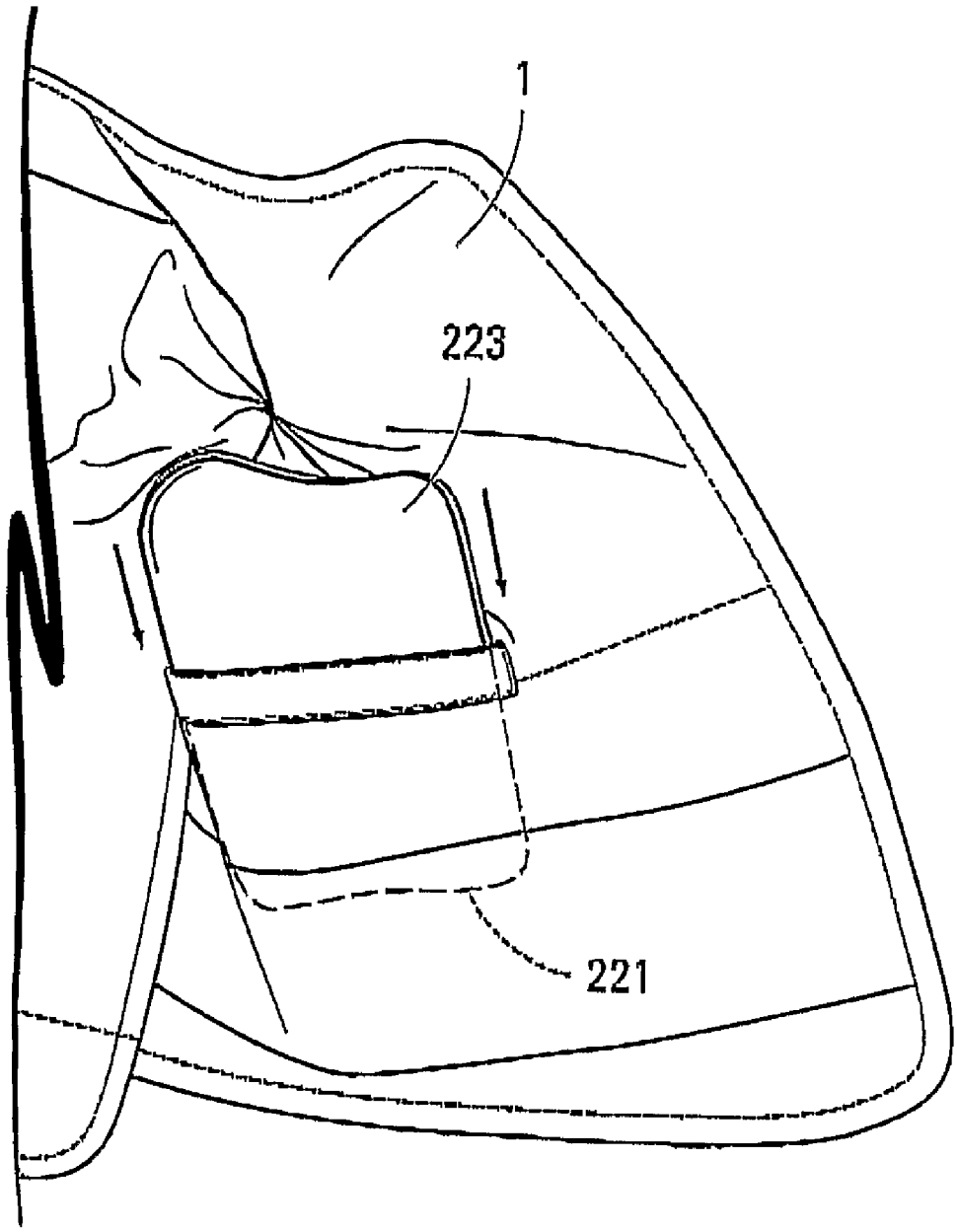
FIG. 9 shows an inside portion of a aide of the protective jacket shown in FIG. 1 with a side blast plate and pocket therefor.

FIG. 9 shows an inside portion of the jacket which includes a pocket 221 and a side protection plate 223. Advantageously, the pocket allows the side protection plate 223 to be removed from the jacket when it is not required. The side plate may comprise one or more layers of ballistic resistant fabric/material, and in one embodiment it may comprise a composite formed of resin and a plurality of layers of ballistic resistant material. The ballistic resistant material may comprise for example, an aramid material, e.g. Kevlar, Spectra, Dyneema, Twaron or any other high-tensile strength material.

Referring to FIGS. 1 and 7A and B, the protective jacket may be provided with extendable sleeves. As shown in FIGS. 1 and 7A and B, the jacket sleeve comprises a main upper sleeve 7, 8 and a lower sleeve extension 10. The right hand sleeve 8 is depicted with the sleeve extension in its fully retracted position and the left hand sleeve 7 is shown with the sleeve extension 10 in an extended position. In this embodiment, the sleeve extension 10 is slideably coupled to the main sleeve 7, 8 so that it can slide up and down within the main sleeve, although in other embodiments, the sleeve extension may slide over the outside of the main sleeve.

In this embodiment, the main sleeve can be opened longitudinally along at least a portion of its length and a fastener 12 such as a zipper (or other fastener) is provided for this purpose. Enabling the sleeve to be opened in this manner allows the sleeve to be modified to enhance its protective capabilities by, for example, allowing one or more blast protective plates to be inserted into the sleeve, as described below.

Figure 10A:
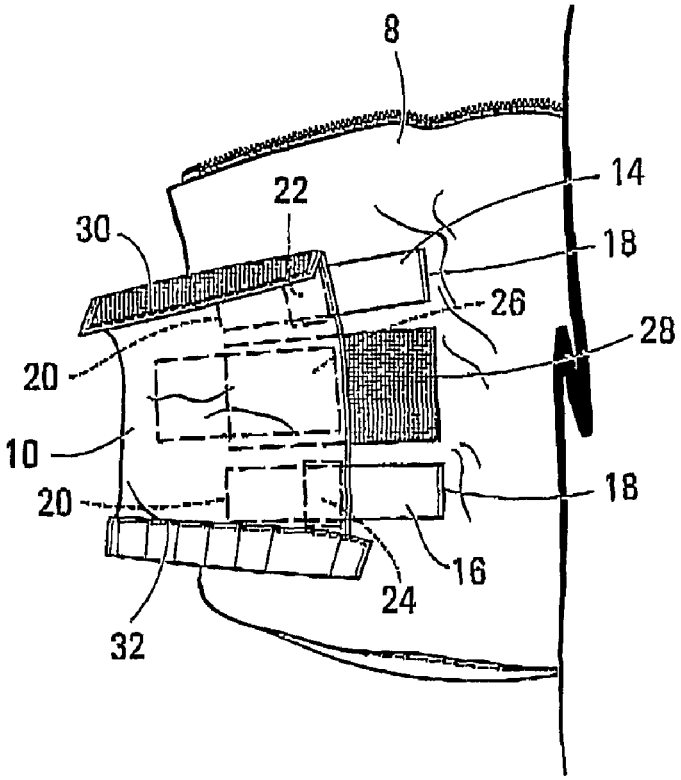
FIG. 10A shows a plan view of an extendable sleeve according to an embodiment of the present invention, with the main sleeve and sleeve extension both in the open position.
Figure 10B:
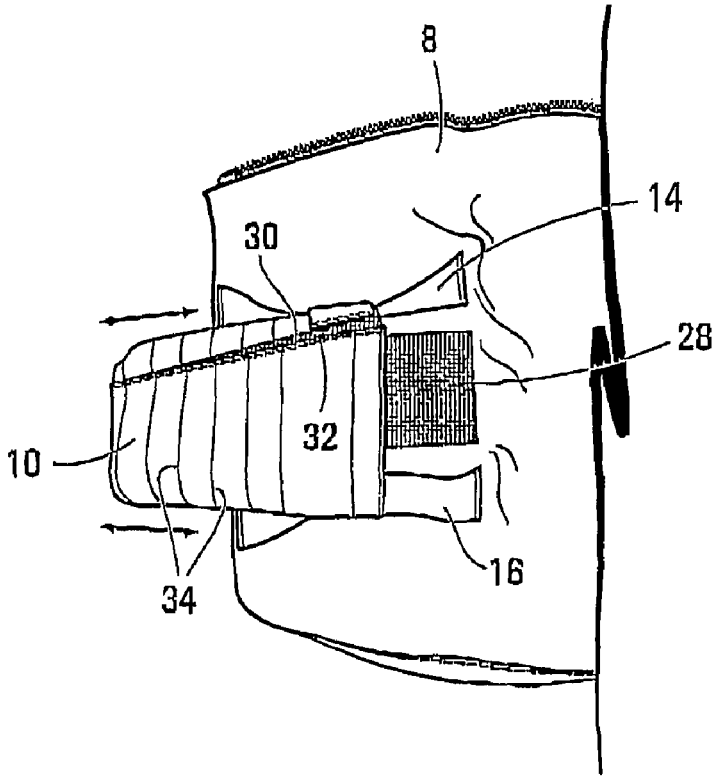
FIG. 10B shows a plan view of the sleeve shown in FIG. 10A with the sleeve extension in the closed position.

An embodiment of the sleeve extension is shown in more detail in FIGS. 10A and 10B, which show a lower portion of the main part 8 of the sleeve in the open position.

Referring to FIGS. 10A and 10B, the sleeve extension 10 comprises a web of flexible protective material (e.g. a high tensile strength material such as an aramid or other polymeric Material) which is slideably mounted to the inside of the main sleeve 8 by first and second sliders 14, 16. In this embodiment, the sliders each comprise an elongate strip of material, each end of which 18, 20 is attached to the main part of the sleeve, and generally directed along its length. Each slider passes through an opening 22, 24 provided on the sleeve extension and which may be provided by a separate strip of material fastened at both ends on the outside surface of the sleeve extension or by some other means such as two or more slits through the sleeve extension.

A locking means 26, 28 may also be provided to lock the sleeve extension in at least one position relative to the main sleeve 8. In the present embodiment, the locking means comprises a surface based fastening system such as Velcro, in which a first Velcro strip or pad 26 is provided on the sleeve extension and a complementary Velcro strip or pad 28 is provided on the main sleeve. In other embodiments, any other suitable locking means may be provided.

As shown in FIGS. 10A and 10B, the sleeve extension can be opened along its length and can be secured in the closed position shown in FIG. 10B by any suitable fastening means, such as a fastener adjacent its opposed longitudinal edges 30, 32. For example, the fastener may comprise a surface based fastener such as Velcro, or any other fastener.

The sleeve extension may comprise at least one visual indicator 34 to indicate the position of the sleeve extension relative to the main sleeve. In this embodiment, the indicator comprises a line which extends transversely of the sleeve extension and may be provided by any suitable means, for example stitching or marking. In this embodiment, a plurality of visual indicators 34 are provided at spaced intervals along the length of the sleeve extension, and in one embodiment, the distance between adjacent markings may be substantially the same and/or may correspond to a convenient measurement such as one centimetre or one inch, or an arbitrary spacing. Advantageously, the visual indicator(s) assists a user in always extending the sleeve extension to the same position.

Advantageously, the sleeve extension is mounted within the main sleeve to reduce its bulk and increase comfort. To move the sleeve extension from a retracted position to an extended position, the sleeve extension is simply unlocked from the main sleeve by releasing the locking means, is then pulled to the desired extended position and re-locked in place.

Figure 11:
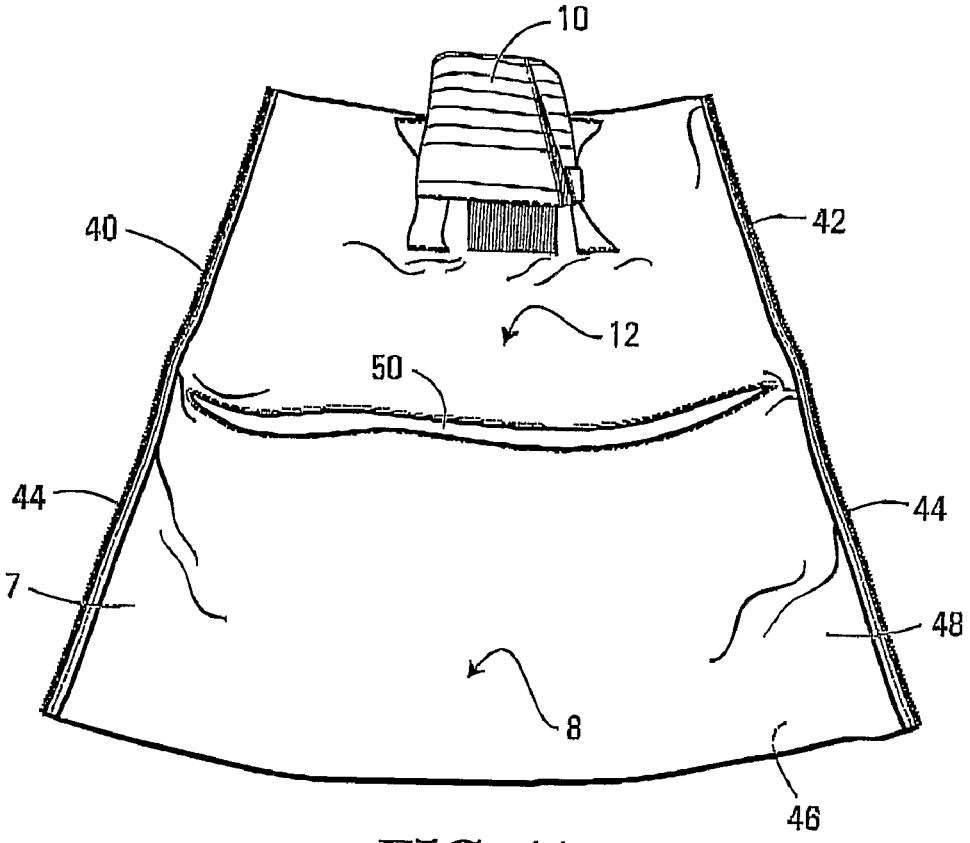
FIG. 11 shows a plan view of a sleeve in the open position with an opening for receiving a sleeve insert.

As mentioned above, the sleeves of the jacket can be opened to allow the sleeve to be modified by adding or removing inserts to change the level of protection. FIG. 11 shows an embodiment of a sleeve which is fully opened along its length. The sleeve 7 has an upper arm portion 8, a lower arm portion 12, opposed longitudinal edges at 40, 42 provided with a fastener 44, for example, a zipper to allow the sleeve to be opened and closed. The sleeve may also be provided with a sleeve extension 10, as described above. The sleeve comprises an outer layer of material 46 (shown in FIG. 1) and an inner lining 48 (shown in FIG. 11). The inner lining has an opening 50 formed therein for receiving a protective insert when an increased level of protection is required. The sleeve may comprise one or more layers of protective material, such as a ballistic resistant material, e.g. a high tensile strength material (e.g. fabric) such as aramid or other polymeric material.

Figure 12:
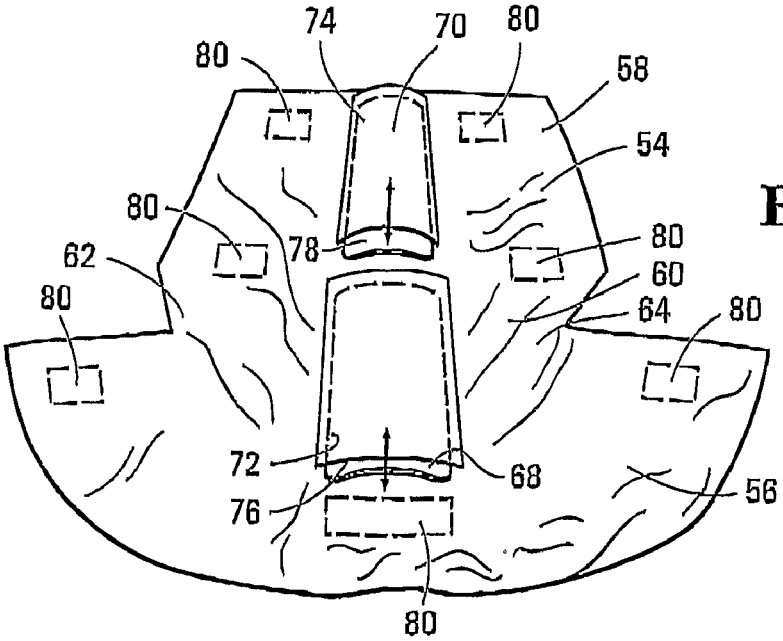
FIG. 12 shows a plan view of a sleeve insert according to an embodiment of the present invention.

FIG. 12 shows an embodiment of a protective insert which can be inserted into the sleeve in the pocket formed between the outer layer 46 and inner lining 48. The protective liner 54 comprises one or more layers of material such as a ballistic resistant material to provide enhanced protection from high velocity fragments, and the number of layers used will depend on the level of protection required. The protective liner 54 has upper and lower arm portions 56, 58 with the upper arm portion being generally wider than the lower arm portion. The liner also has an elbow region 60 in which material is removed to form reliefs to reduce bunching of material when the arm is bent about the elbow joint.

As an additional level of protection, one or more protective plates may be mounted to the protective insert 54, and in the present embodiment, the protective insert allows both an upper arm and lower arm plate 68, 70 to be mounted thereto. In this embodiment, upper and lower pockets 72, 74 are provided for receiving and retaining the protective plates. Each pocket has an opening 76, 78 to allow the plates to be inserted, removed or replaced Any other fastener may be provided to hold the protective plate(s) in place. The protective insert may include a cover, for example a cover of waterproof or water-resistant material such as nylon. One or more fasteners 80 may be provided on the insert for holding the insert in place within the sleeve to prevent relative movement thereof. The fasteners may comprise any suitable fastening means and in one embodiment comprise a surface based fastener such as Velcro. The protective liner may be inserted into the jacket sleeve to provide additional protection, with or without one or more additional protection plates.

The arm plates may be designed to protect the arm against high velocity fragments, and in one embodiment comprise a resin based composite of multiple layers of ballistic resistant material e.g. an aramid, such as Kevlar, Twaron or Dyneema, or other ballistic resistant fabric. The fabric may be pretreated with resin and molded to the required shape in a press under high pressure. The layers may also be heated in the press.

In other embodiments, the arm plates may be formed of any other suitable material, depending on the level of protection required, and may comprise polycarbonate or similar material, and may additionally include a foam layer on the inside thereof. The plates may be formed in any desired shape and may be generally curved to conform to the general curvature of a person's arm.

Figure 13A:
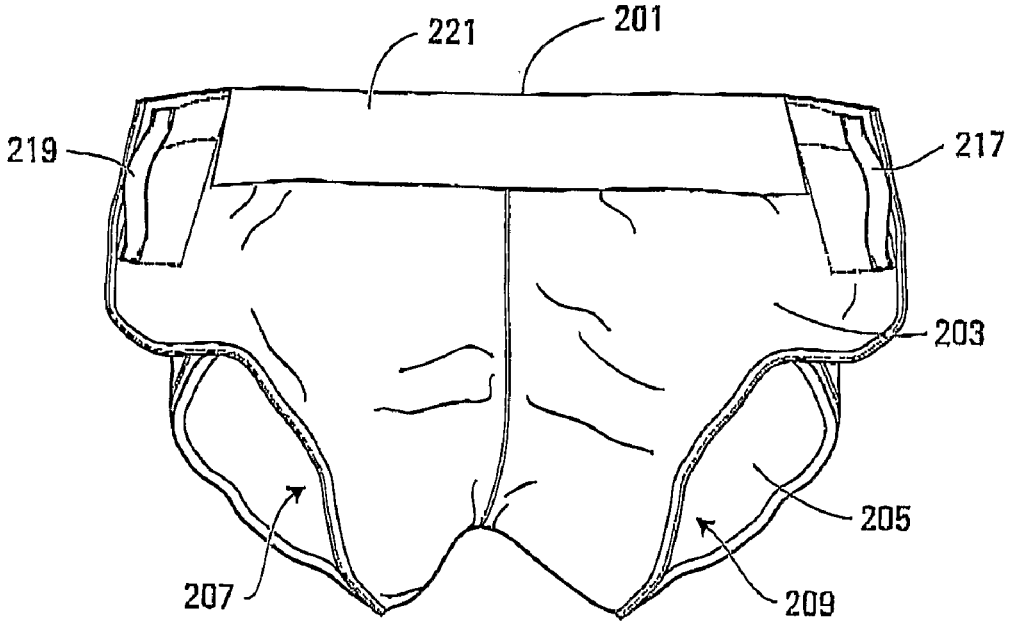
FIG. 13A shows a front view of a groin protector according to an embodiment of the present invention.
Figure 13B:
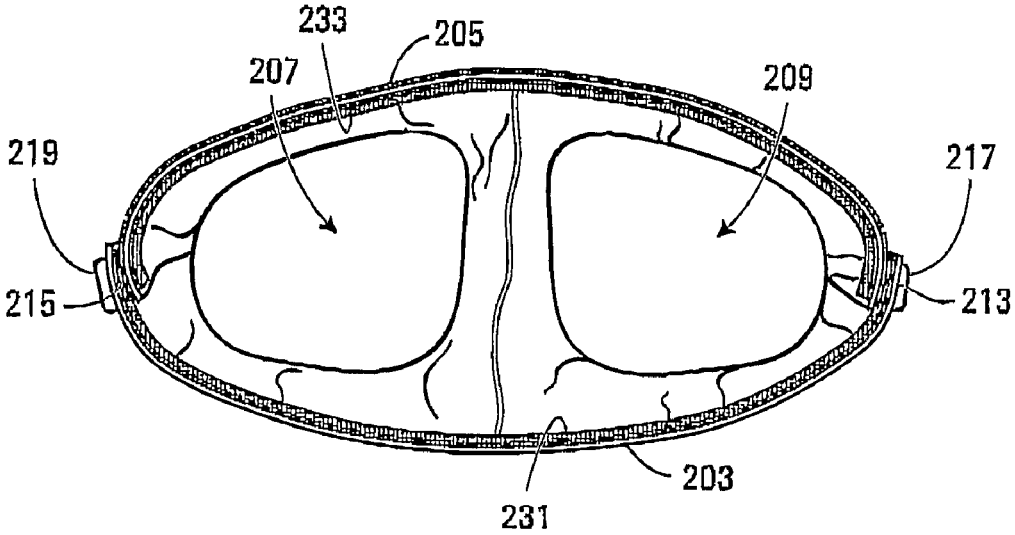
FIG. 13B shows a top view of the groin protector shown in FIG. 13A.
Figure 13C:
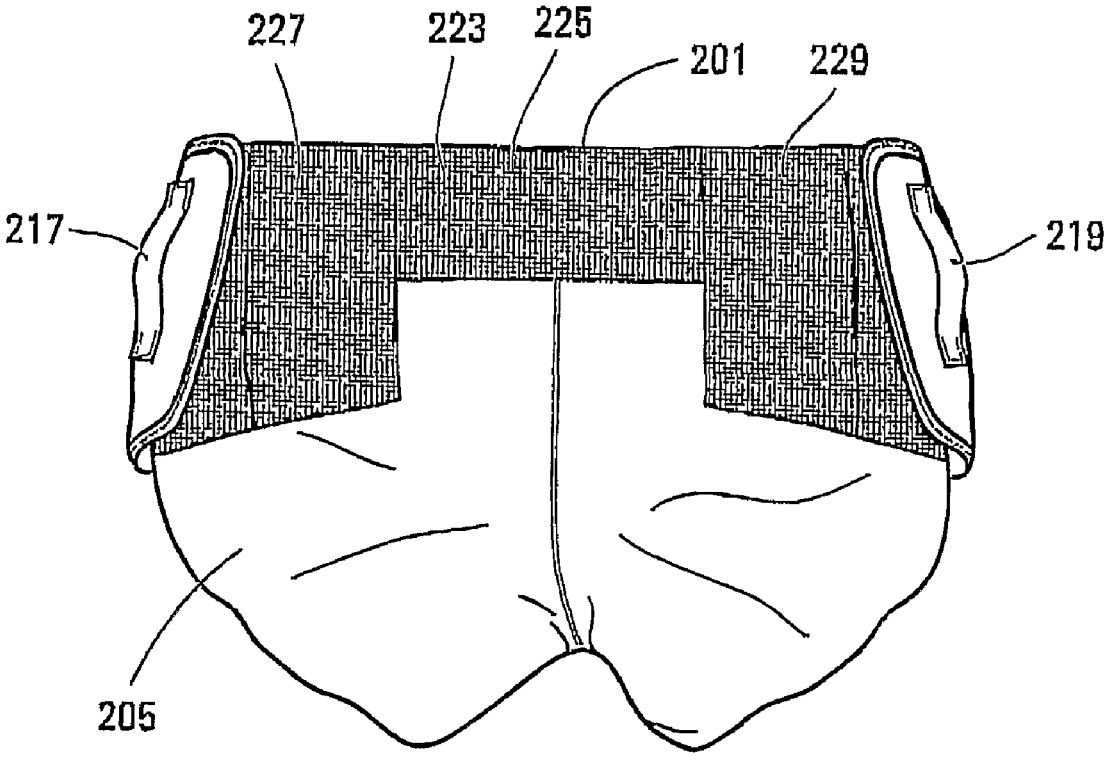
FIG. 13C shows a rear view of a groin protector according to an embodiment of the present invention.
Figure 13D:
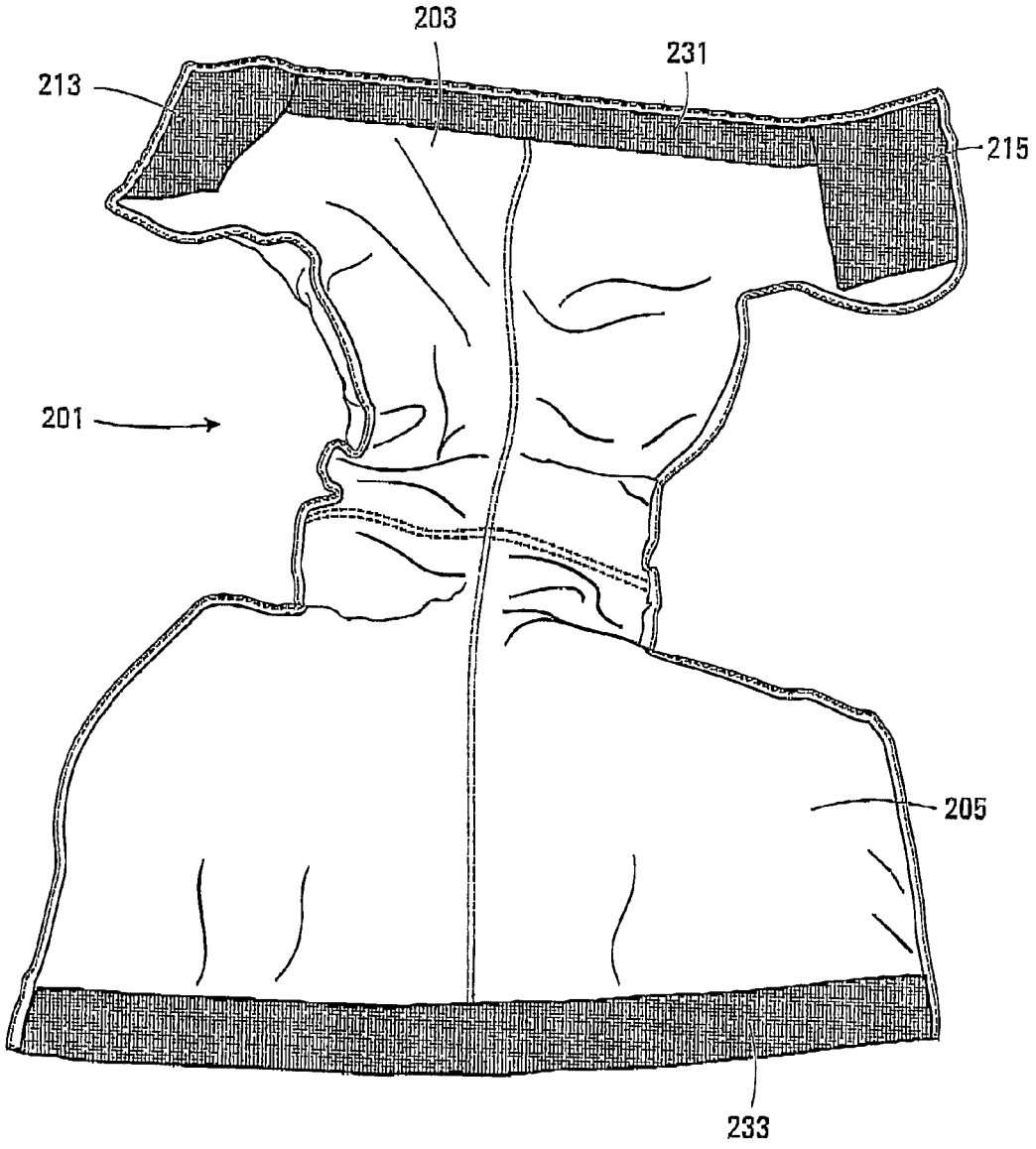
FIG. 13D shows an inside view of the groin protector in the open position.

FIGS. 13A to 13D show an embodiment of a groin protector which may be used with the jacket. The groin protector 201 has a front 203 and a back 205 and leg openings 207, 209. As shown in FIG. 13B, the front portion 203 is releasably attached to the rear portion 205 by suitable fasteners 213, 215, such as hook and loop fasteners. To put on the groin protector, the groin protector is opened by detaching the front and rear portions from each other, as shown in FIG. 13D, the protector is drawn up between the legs and the front and back portions are fastened together around the waist. The protector is removed simply by releasing the front portion from the back portion and stepping out of the protector. Advantageously, in this embodiment, pull members 217, 219 such as pull handles are provided on either side of the front portion of the groin protector to facilitate release of the front portion from the rear portion and quick removal of the protector. In another embodiment, pull members may be provided on the rear portion, to facilitate pulling the rear portion from the front portion.

Referring to FIGS. 13A, 13B and 13C, the groin protector may be provided with one or more fasteners to fasten the groin protector to a jacket such as the protective jacket described above with reference to FIGS. 1 and 2. In the exemplary embodiment shown in FIGS. 13A to 13C, the fastener may conveniently comprise a hook and loop type fastener with one or more fastening regions being provided around the waist of the groin protector. In one embodiment, the groin protector includes a front fastener 221 formed as a continuous (or discontinuous) strip along the front waist portion of the groin protector and a fastener 223 on the rear portion of the groin protector. In this embodiment, the rear fastener comprises an intermediate elongate fastening strip 225 along the middle waist region. Two side fasteners 227, 229 are also disposed about the waist region and which may extend downward and beyond the middle fastener 225. The side fasteners 227, 229 also function as a fastening area to fasten the front portion of the groin protector to the rear portion thereof, allowing adjustment for different waist sizes.

One or more complementary fasteners may be provided on the inside of the jacket, for example around the waist region to secure the groin protector thereto.

Referring to FIG. 13D, one or more fasteners may also be provided on the groin protector to enable the groin protector to be fastened to protective leggings, an example of which is described below with reference to FIG. 14. In the embodiment of FIG. 13D, fasteners are provided on the front and rear portions of the groin protector and may comprise fastening strips 231, 233 positioned along the waist.

Figure 14:
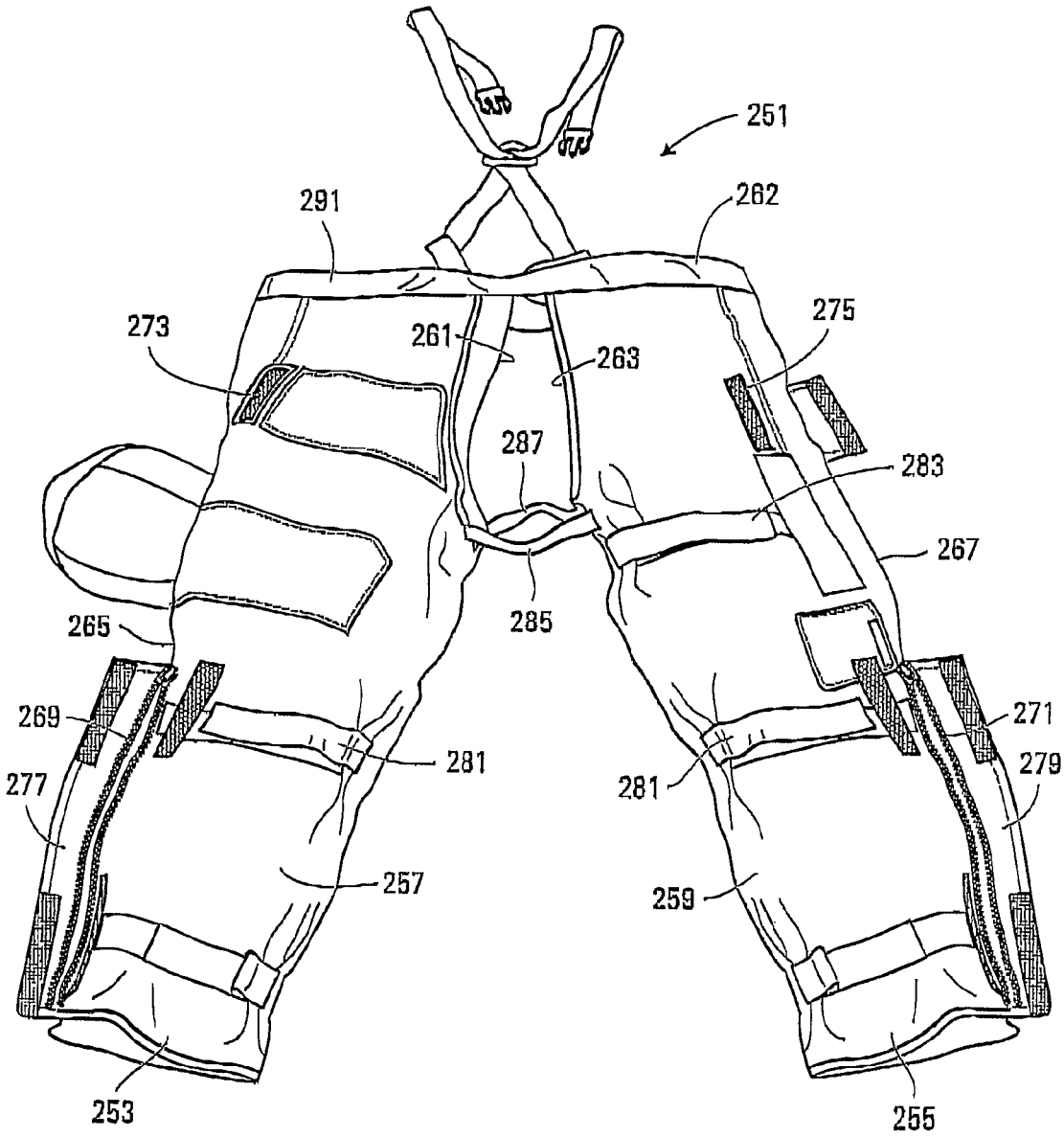
FIG. 14 shows a front view of a leg protector according to an embodiment of the present invention.

FIG. 14 shows an embodiment of a leg protector or protective pants or trousers 251. The leg protector 251 comprises first and second leggings 253, 255 each having front portions 257, 259 and rear portions 261, 263. The leggings can open along their respective outer sides 265, 267 to facilitate donning and doffing. The front and rear portions of each legging can be fastened together along their respective outer sides by any suitable fasteners, which may include one or more zippers 269, 271 and/or one or more contact fasteners such as hook and loop fasteners 273, 275. One or more flaps 277, 279 may also be provided to cover the join along the outer side of the leggings when the front and rear portions are fastened together. One or more legging circumference adjusters 281, 283 may be provided to allow the leggings to be tightened or loosened around the leg of a wearer for comfort and fit. The leggings 253, 255 are attached at a waist region 262 and also by one or more webs 285, 287 at the groin region. In this particular embodiment, a first web 285 is provided and attached to the front portions 257, 259 of the leggings and a second web 287 is connected between the rear portions 261, 263 of the leggings. Advantageously, the width of the webbings is relatively narrow and the webbings are in the form of elongate strips in order to reduce the material in the groin region and the possibility of material bunching and discomfort, particularly when the leggings are worn with a groin protector placed over the leg protector. Any other suitable fastener(s) may be used.

The leg protector may be conveniently provided with one or more fasteners for fastening to a groin protector placed thereover and in this embodiment, the fastener comprises a contact fastener 291, for example a hook and/or loop fastener such as Velcro, which engages a similar fastener on the inside of the groin protector, as shown in FIG. 13D. The fastener 291 may comprise a continuous band or strip in the waist region of the leg protector at both the front and back of the protector or one or more individual fasteners may be suitably placed on the leg protector.

In this embodiment, shoulder braces or suspenders are provided to allow the leggings to be supported and suspended from the shoulders of a wearer, again to facilitate donning and doffing (for example to support the leggings while fastening or unfastening the front and rear portions thereof) and to more securely attach the leggings to a wearer.

The leggings may include one or more layers of protective material such as ballistic resistant material, for example an aramid such as Kevlar, Dyneema, Twaron or any other high strength fabric or material.

The leggings may include one or more optionally detachable protective plates, to provide additional protection to various parts of a wearer's legs, including any one or more of the knee, thigh and shin. The plates may be mounted in pockets provided on the leggings.

Figure 15:
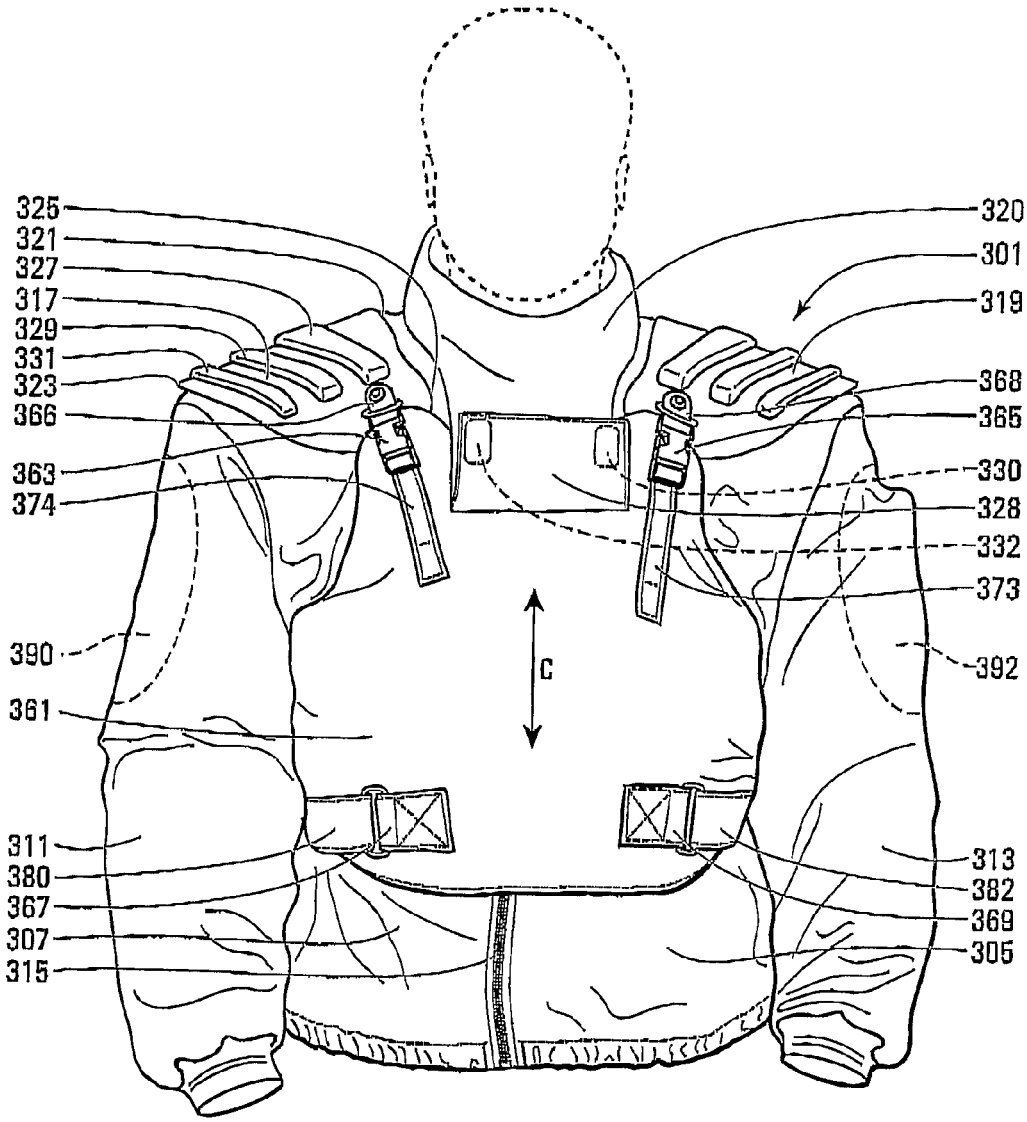
FIG. 15 shows a front view of an upper body protective ensemble according to an embodiment of the present invention.
Figure 16:
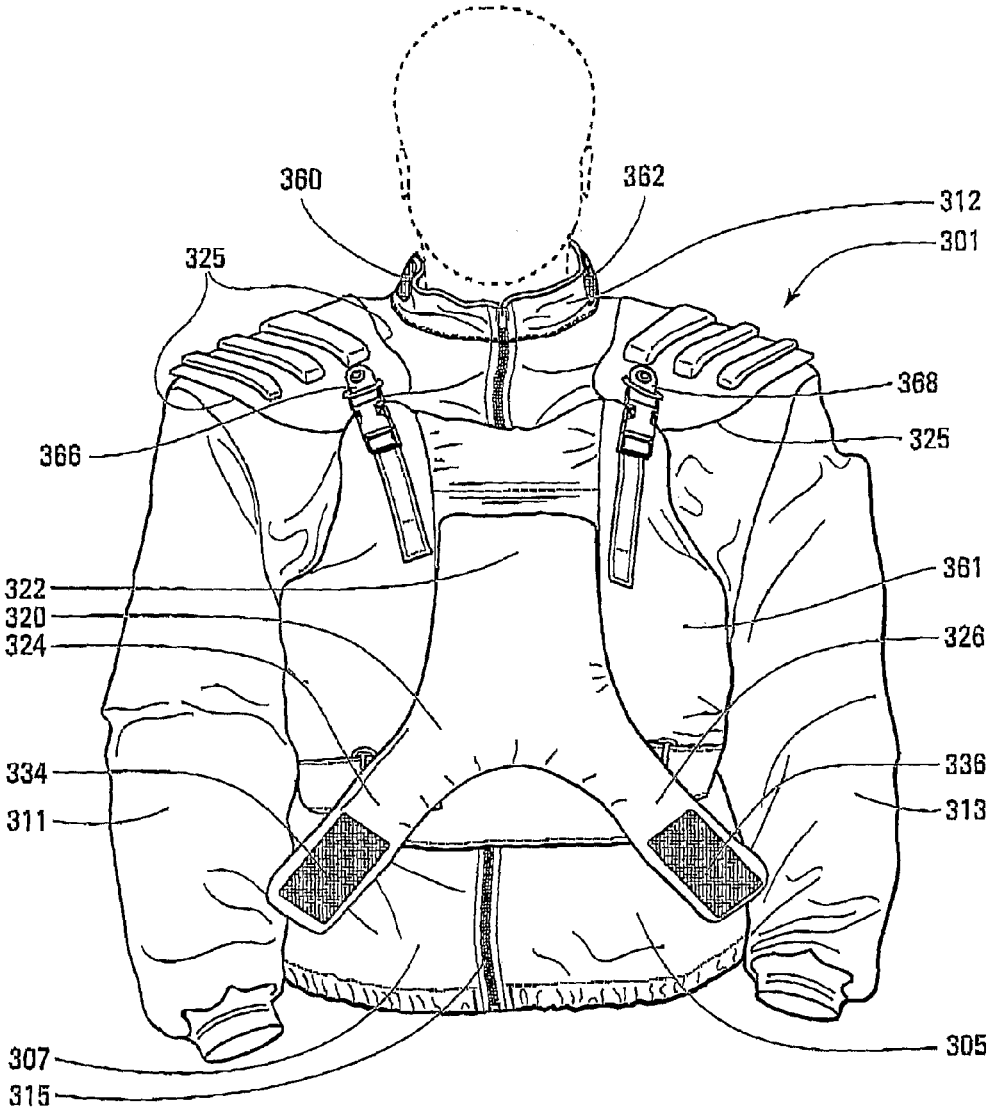
FIG. 16 shows a front view of the protective ensemble shown in FIG. 15 with the protective collar in the open position.
Figure 17:
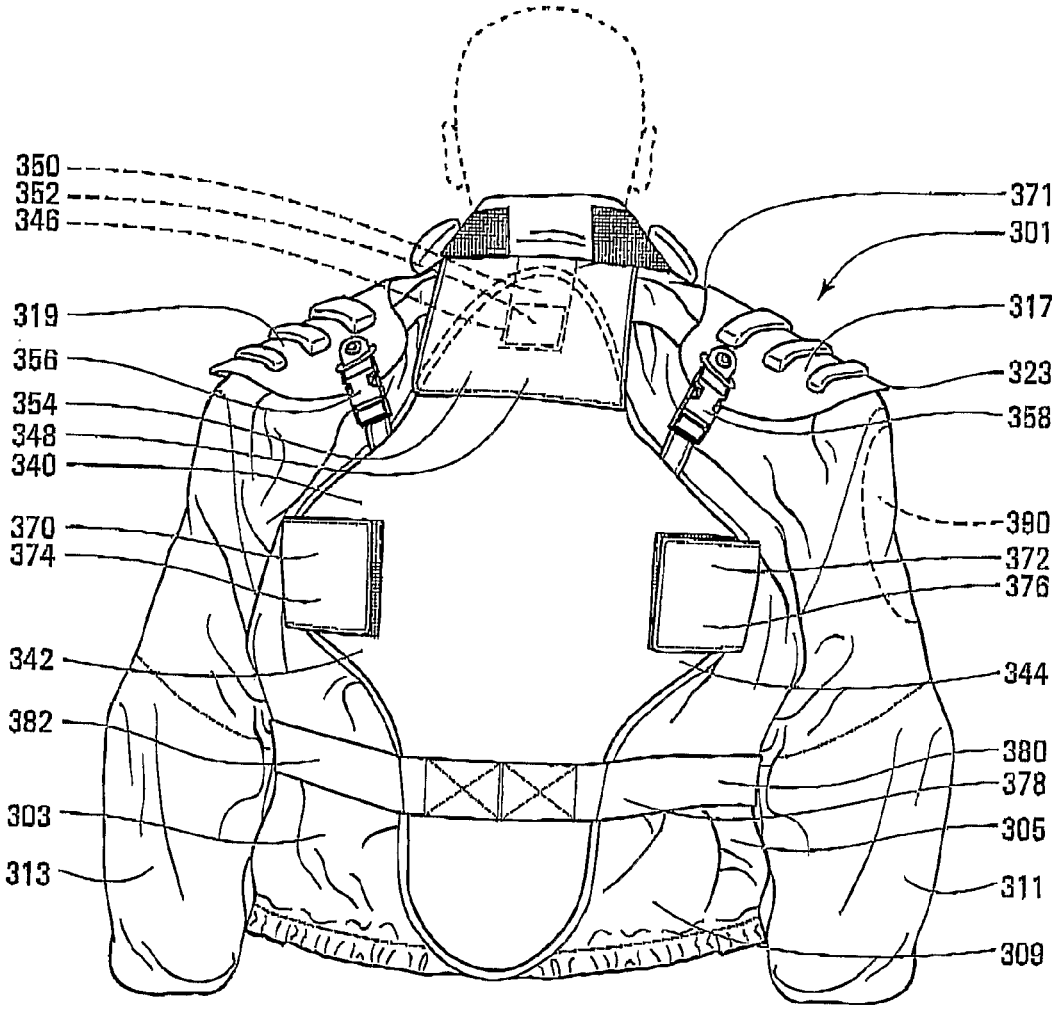
FIG. 17 shows a rear view of the protective ensemble according to an embodiment of the present invention.

Another embodiment of a protective jacket is shown in FIGS. 15 to 17. The jacket comprises a base jacket which is worn like any standard jacket and one or more protective components may be attached to the base jacket. The base jacket itself may comprise any desired material, for example light-weight, tedium-weight or heavy-weight material and may or may not comprise a protective material such as a ballistic resistant fabric (e.g. an aramid or other polymeric fabric). One or more protective components can be removably attached to the base jacket to allow the level of protection afforded by the jacket to be varied or modified depending on the threat or application. The modularity of the protective jacket provides significant flexibility in terms of its application, facilitates donning and doffing and also facilitates cleaning the garment as the protective components can be removed and the base jacket laundered. Advantageously, the various protective components are attached to the jacket and/or to each other rather than needing to be attached individually to the wearer which would otherwise increase the time for donning and doffing.

Referring to FIGS. 15 to 17, the protective jacket, generally shown at 301, comprises a base jacket 303 having a torso portion 305 with a front 307 and a rear 309, 309 and optionally includes left and right sleeves 311, 313. The base jacket may be made from any suitable material and may open at the front and be fastened closed using any fastening means 315 such as a zipper, popperstuds, a hook and loop fastener and/or buttons and eyes, or any other fastener. The protective components that may be secured to the jacket may comprise any one or more of the following.

1. Shoulder Protector

Left and/or right shoulder protectors 317, 319 which may comprise rigid or semi-rigid plates or other material, are releasably securable to the jacket and may be secured either to the outside of the jacket as shown in FIGS. 15 to 17 or, alternatively, to the inside of the jacket. The shoulder plates generally extend from the neck region 321 of the shoulder to the arm region of the shoulder 323 and also extend over a front portion of the shoulder. The front edge 325 of the shoulder plate may be shaped for comfort and so as not to interfere with the wearer's collar bone. The shoulder plate also extends over a rear portion of the shoulder, as shown in FIG. 17. The shoulder plates may include reinforcement means such as one or more embossed portions 327, 329, 331 and which may be of any desired shape or form. In the present embodiment, the reinforcement means comprises a plurality of elongate ridges (which may be formed by embossing), with each ridge extending from the front portion to the rear portion of the shoulder plate and which all run in the same general direction. In other embodiments, the shoulder plate(s) may be provided with any other pattern or configuration of ridges.

Figure 18A:
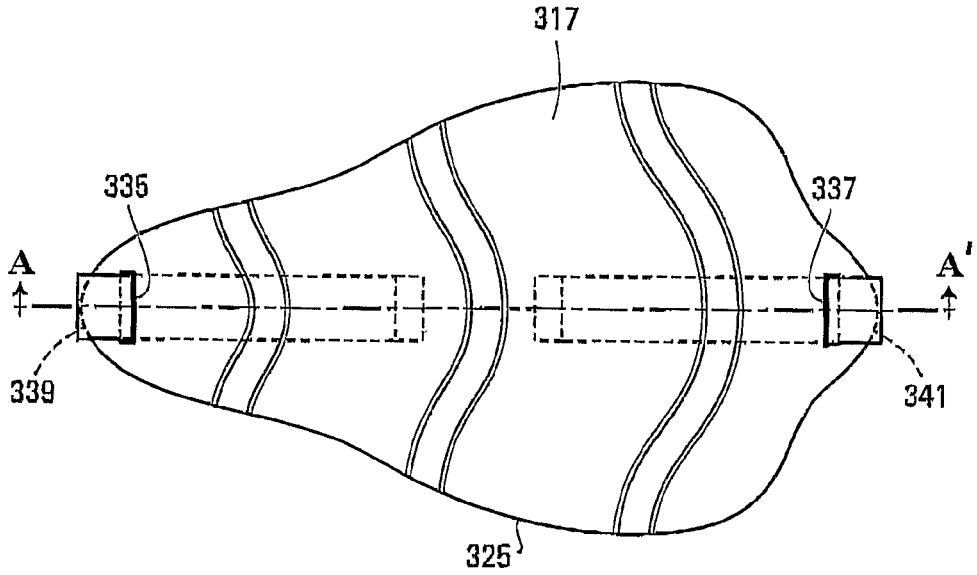
FIG. 18A shows a top view of a shoulder protector according to an embodiment of the present invention.
Figure 18B:
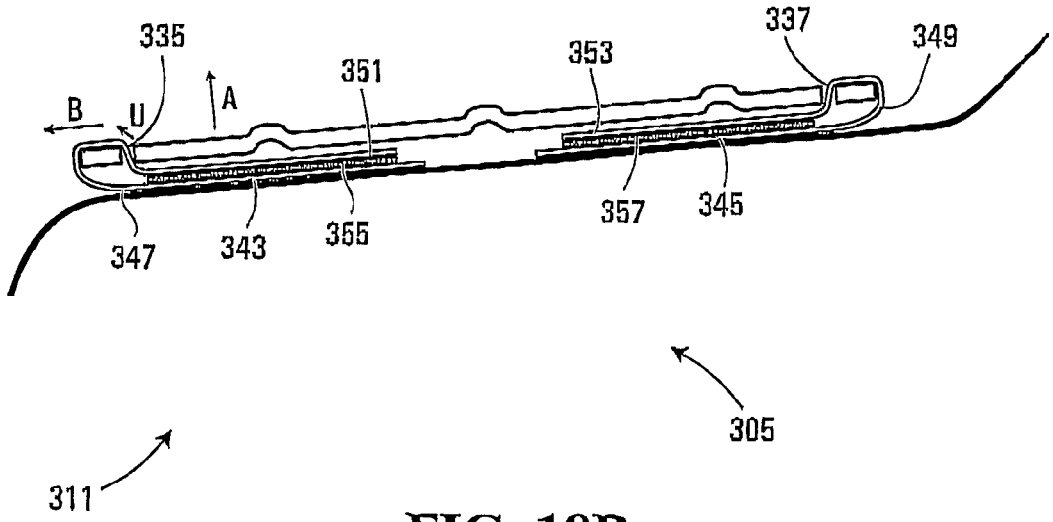
FIG. 18B shows a cross-sectional view of the shoulder protector of FIG. 18A along the line A-A-.

The shoulder plates can be detachably secured to the jacket by any suitable means, an example of which is shown in FIGS. 18A and 18B. Referring to FIGS. 18A and B, the shoulder protector plate 317 has first and second apertures or slits 335, 337 formed therein and positioned adjacent opposite ends 339, 341 thereof. Contact based fasteners such as hook or loop fasteners 343, 345 are attached to the shoulder portion of the jacket as best shown in FIG. 18B. A fastening web or strap 347, 349 is also fastened to the shoulder portion of the jacket and each has a free end 351, 353. To secure the shoulder plate on the jacket, the free end is passed around the end 339, 341 of the plate and through the aperture or slit 335, 337. The web includes a complementary fastener 355, 357 which engages the other fasteners 343, 345 to secure the shoulder plate to the jacket.

Advantageously, in this arrangement, the fastening means is positioned below the shoulder plate and is covered and protected by the plate. Therefore, the fasteners are generally inaccessible or very difficult to access when the jacket is worn, making the shoulder plates extremely difficult if not impossible to remove by pulling thereon. Furthermore, although a hook and loop fastening system can be released by pulling one surface away from the other, the engaged surfaces are very resistant to shear forces. In the arrangement shown in FIGS. 18A and 18B, it is not possible to pull the hook and loop surfaces away from one another from outside the shoulder plate as the fasteners are inaccessible. Pulling on the shoulder plate in a direction generally perpendicular to its surface, as shown by arrow A, will translate into a shear force component applied between the fastening members of the hook and loop fastening system to which the fastening system is highly resistant. Therefore, it will be extremely difficult to lift the shoulder plate off the shoulder. Similarly, pulling on the shoulder plate in the lateral direction as indicated by arrow B will also translate into a shear force between the fastening members, again making it extremely difficult to remove the shoulder plate in this manner. In order to remove the shoulder plate, the jacket is removed from the wearer so that the upper portion of the jacket shoulder can flex away from the shoulder plate creating a gap therebetween from which the fasteners can be directly accessed. In other embodiments, the shoulder plate fasteners may be positioned at any other suitable position, for example on the front and back of the jacket so that the arrangement of FIGS. 18A and 18B is effectively rotated by about 90°, for example, and such a fastening system may be implemented as an alternative to that shown in FIGS. 18A and 18B or as an addition thereto. The fastening system and/or the general principles thereof may be used to fasten any other components to the garment and/or to each other.

In another embodiment, two slits may be formed in the shoulder protector for each fastener so that the fastener passes through one slit from the jacket and back through the second slit to fasten to the jacket. The provision of a second slit removes the need for a fastener to pass around the end of the shoulder protector.

2. Front Protective Plate

A protective front plate 361 may be provided to protect the front torso portion of a wearer and may comprise any rigid or semi-rigid material to protect against blunt impacts, for example, and/or may comprise a ballistic resistant material to protect against sharp impacts from bullets, other high velocity projectiles, blast fragments and/or other sharp objects.

The protective front plate 361 may be detachably fastened to the front of the jacket by any suitable means and may be fastened to the jacket directly or indirectly. In this particular embodiment, the front plate 361 includes fasteners 36B, 365 which couple to complementary fasteners 366, 368 on the shoulder plates 317, 319. These front plate fasteners are positioned on the left and right sides and advantageously allow the front plate to be opened either from the left or right-hand side and swung away from the jacket to allow the jacket to be opened. Lower left and right side fasteners 367, 369 are also provided to secure the front plate 361 against the jacket and these fasteners may secure the lower portion of the front plate either directly to the jacket or indirectly thereto, and an example of this latter implementation is described below. The upper front plate fasteners 363, 365 are adjustable to allow the position of the front plate to be raised and lowered as indicated by arrow C, as required, for example to suit the size of the wearer, his or her comfort and/or the particular application. Adjustability of the fasteners may be provided by mounting the fasteners on straps or webs 371, 373 whose length can be varied.

3. Protective Collar

A protective front collar 320 has the form of a Y, and comprises a lower portion 322 and left and right bifurcated portions 324, 326, as best shown in FIG. 16. The lower portion may be secured either directly or indirectly to the jacket, and may be attached in such a way that the protective collar can fold downwards away from the neck and over the front of the jacket, as shown in FIG. 16. In this embodiment, the protective collar 320 is detachably secured to the front plate 361. In particular, the fastening arrangement includes a flap 328 which is secured to the front plate 361 and which includes one or more fasteners for releasably fastening the lower portion 322 of the protective collar thereto. The fastener may comprise any suitable fastener, for example a hook and loop-type fastener 330, 332. The left and right forked portions 324, 326 are designed or shaped to curve around the front and sides of the neck of a wearer and include fasteners 334, 336 for securing the forked portions to the jacket. In this particular embodiment, the jacket includes a collar portion 312 and complementary fasteners 360, 362 are provided thereon which engage and fasten with the fasteners 334, 336 on the forked portions of the protective collar. In one embodiment, the fasteners comprise hook and loop type fasteners although it will be appreciated that any other type of fastener may be used.

Advantageously, the upper portions of the protective collar can be readily detached from the jacket and folded away from the wearer when the collar is not required and for increased-ventilation and comfort. Since, in this embodiment, the protective collar is attached to the front plate, removal of the front plate will also remove the protective collar thereby reducing the number of steps for both donning and doffing the collar. The protective collar may comprise any suitable material, including one or more layers of relatively soft flexible material such as foam. The material and construction of the protective collar may be selected for the desired level of threat. In some embodiments, the collar may comprise one or more layers of ballistic resistant or high tensile strength material, such as an aramid or other material. When the front plate is used without the protective collar, the fastening flap 328 may be simply fastened against the front plate by any suitable fastening means such as hook and loop fasteners.

4. Protective Back Plate

A protective back plate may be detachably secured to the jacket for protecting parts of the back of a wearer such as the spine and kidneys. An example of an embodiment of the detachable back plate is shown in FIG. 17. In this embodiment, the back plate 340 is generally elongate and extends from the neck region to or below the base of the spine, and includes left and right side portions or lobes 342, 344 extending laterally therefrom. The back plate 340 may be detachably secured to the jacket either directly or indirectly or a combination of both. In this embodiment, the upper portion 346 of the back plate is secured to the jacket by means of a hook and loop type fastener (although any other fastener could be used). A fastening region 348 is provided on the outer surface of the back plate and a web 350 carrying a complementary fastener 352 extends from an upper middle portion of the rear of the jacket and fastens to the upper plate fastener 348. A flap 354 is provided to cover this fastening system.

In this embodiment, additional (or alternative) left and right upper fasteners 356, 358 are provided to secure the back plate to the shoulder plates 317, 319. The fasteners may comprise snap fasteners and may be adjustable to allow the back plate to be raised and lowered as required. Lateral fasteners 370, 372 may be provided on the lateral lobes 342, 344 of the back plate to secure the back plate to the jacket. In this embodiment, the lateral fasteners each comprise a hook and loop type fastener with one of the fastening components placed on each lateral portion and a complementary fastener provided on a lateral flap 374, 376 attached to the jacket. When the back plate is removed, the flaps may be secured directly to the jacket using similar fasteners or any other fastener. In other embodiments, the lateral fastener may comprise any other suitable fasteners.

A lower fastener 378 is also provided to secure the lower portion of the back plate either directly or indirectly to the jacket. In the present embodiment, the fastener 378 comprises left and right lateral webs 380, 382 which are fastened to a lower portion of the back plate and extend laterally therefrom around each side of the jacket to the front. The webs or straps are provided with fasteners which fasten to a front plate, for example front plate 361 shown in FIG. 15. Advantageously, securing the back plate to the front plate, rather than to the jacket enables both the front and back plates to be secured in place with the same fasteners, eliminating the need for separate fasteners and reducing the number of steps involved in donning and doffing the protective plates. However, in other embodiments, the front and/or rear plates may be secured to the jacket, and complementary fastener(s) may be provided on the jacket for this purpose.

5. Protective Arm Plate

One or more protective plates may be detachably mounted to the arm for additional protection. In one embodiment, a protective upper arm plate 390, 392 is provided for each arm and may be inserted into a pocket formed in the upper arm of the jacket or secured in place by any other suitable mechanism. The pocket may have an opening which is accessible either from the inside or from the outside of the jacket or both. The protective upper arm plate may comprise any suitable material, including rigid or semi-rigid materials, e.g. plastics or foam, one or more layers of ballistic resistant material and/or any other suitable material.

All of the protective components described above can be removed from the jacket to allow the jacket to be washed, dry-cleaned or laundered. Each component may be used with the jacket either alone or in combination with any one or more other components and the interconnection, between components facilitates donning and doffing and reduces the number of steps required to do so. The various interconnections also ensure that each component is securely fastened to the jacket and cannot easily be detached by pulling. This assists in increasing the confidence of personnel wearing the protective garment, particularly in crowd management applications.

The jacket may be part of a protective ensemble which includes protective pants. In one embodiment, each leg of protective pants can be opened at the back by means of a releasable fastener such as a zipper or other fastener to facilitate donning and doffing the pants and so that the pants can be donned and doffed without removing a wearer's footwear such as boors. The protective pants may also include one or more protective plates which may be removable therefrom, such as one or more hip plates and one or more thigh plates. The protective plates may comprise any suitable material such as semi-rigid or rigid materials, e.g. plastics or foam or other material. The protective plates may be inserted into pockets provided in the pants and the pockets may be opened from the inside and/or outside of the pants. The protective ensemble may further include one or more additional limb guard(s) such as an elbow and/or lower arm guard and/or a knee and/or shin guard. The limb guards may be worn either inside or outside the protective garment.

It is to be noted that the protective garments described herein may be used in combination with other protection such as ballistic resistant vests and/or other known protective garments.

Figure 19:
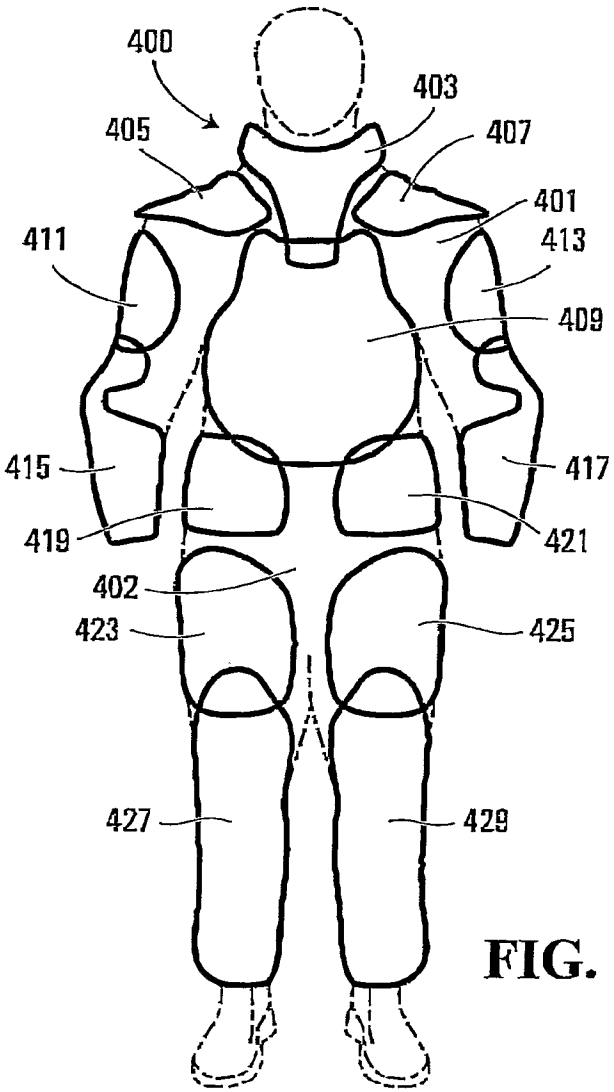
FIG. 19 shows a front view of a protective ensemble according to an embodiment of the present invention.
Figure 20:
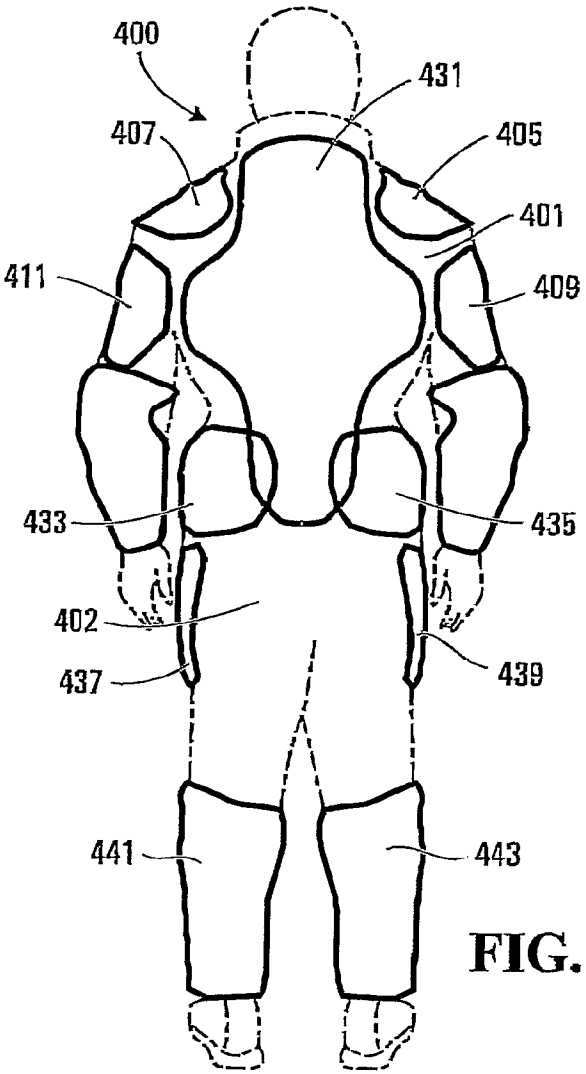
FIG. 20 shows a rear view of the protective ensemble shown in FIG. 19.

An example of a protective ensemble is shown in FIGS. 19 and 20. FIG. 19 shows a front view of the protective ensemble and FIG. 20 shows a rear view of the protective ensemble. The ensemble 400 includes a base jacket 401 and base pants 402 with various protective components mounted thereon. Each protective component may be detachably mounted and the protective ensemble may include any one or more protective components. The components may include a protective collar 403, right and left shoulder plates 405, 407, a protective front plate 409, protective upper arm plates 411, 413, right and left elbow and lower arm guards, 415, 417, front, right and left hip guards (plates) 419, 421, right and left thigh protector plates 423, 425 and right and left knee and front lower leg protectors 427, 429. The protective components may also include a back protector plate 431 and rear right and left hip protector plates 433, 435. Right and left side upper leg protectors 437, 439 and/or right and left lower back leg protectors 441, 443 may also be provided.

In embodiment of the protective ensemble, any one or more of the limb or other protective plates may be mounted in surface pocket(s) or hidden interior pocket(s). This greatly reduces the time required for donning and doffing. Any one or more of the protection plates may comprise a plastic and/or foam material. The modularity of the ensemble increases its versatility for different applications, and provides improved comfort and ease of movement.

Figure 21:
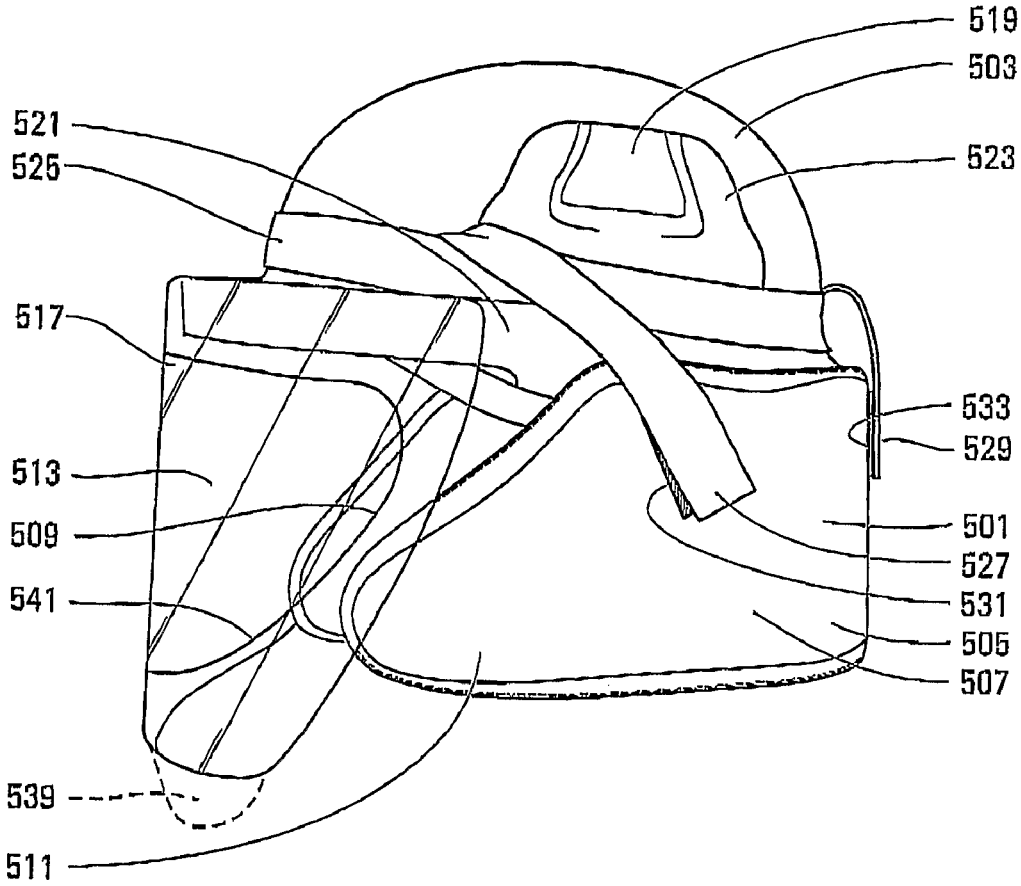
FIG. 21 shows a side view of a helmet and helmet skirt according to an embodiment of the present invention.

FIG. 21 shows a protective skirt for a helmet according to an embodiment of the present invention. The protective skirt 501 is attached to a helmet 503 and extends downwardly therefrom to protect the back and sides of the head and also sides of the face. The skirt comprises a rear portion 505 for protecting the back of the head and neck, opposed side portions 507, 509 for protecting the sides of the head and ears, and opposed front portions 511, 513 for protecting the sides of the face. The helmet skirt 501 may comprise one or a plurality of layers of ballistic resistant fabric or other protective material, depending on the level of protection required. The ballistic resistant material may comprise any known ballistic resistant (or high tensile strength) fabric such as an aramid, e.g. Kevlar, Spectra, Dyneema, Twaron or other materials.

The helmet skirt may be releasably attached to any helmet and is particularly suitable for use with a standard military helmet to enhance the level of protection. In the present embodiment, the helmet is provided with a visor which is carried on a rotatable bracket 521 to allow the visor to be raised and lowered. The bracket 521 is mounted on mounting plates 523 either side of the helmet and which are held in place by a strap or band 525 which surrounds and is tightened against the helmet shell. In one embodiment, the skirt is attached to the helmet by means of a plurality of fastening straps 527, 529 which extend upwards from the skirt, pass around the visor band 525 and are attached to the skirt by a suitable fastener 531, 533, such as hook and loop (e.g. Velcro) or any other suitable fastener.

The visor of the helmet may include a chin extension 539 and/or may also include one or more additional layers of transparent material 541 particularly in the eye region of the visor to provide additional protection.

In other embodiments, the helmet skirt may be mounted to a helmet using any other suitable attachment mechanism or system. The helmet may be used with any one or more other protective component described herein, for example a protective jacket. The collar of the jacket shown in FIG. 1, for example, may be sized to accommodate the lower portion of the helmet and skirt there within.

Other embodiments and aspects of the present invention may comprise any feature disclosed herein in combination with any one or more other feature(s) disclosed herein, and may be claimed separately or in combination.

In any of the embodiments disclosed herein which include ballistic resistant material, the ballistic resistant material may comprise one or more layers of a high tensile strength fabric, such as an aramid material, or other fabric such as nylon or other polymeric material.

In any of the embodiments disclosed herein, which include a jacket, the jacket may comprise a flexible material or fabric, formed of any suitable material or cloth (woven or unwoven) and may comprise one or more layers of flexible material.

Modifications and changes to the embodiments described herein will be apparent to those skilled in the art.

The invention claimed is:

1. A protective garment comprising a torso portion, and over blast protector and a collar, said blast protector secured at a front of said torso portion by a first fastening member, said collar having a front collar portion and a rear collar portion, and a second fastening means for releasably attaching the front collar portion to the rear collar portion at a side of said collar, wherein said rear collar portion is attached to said torso portion, and wherein said second fastening means is adapted to enable said front collar portion to be released from said rear collar portion thereof by pulling said front collar portion towards said front torso portion, and further comprising a pull member connected to said front collar portion adjacent said second fastening means for releasing said front collar portion from said rear collar portion such that said front collar portion is detachable from said protective garment; said pull member further connected to said over blast protector such that said over blast protector and said front collar portion can be released from the protective garment at the same time.

2. A protective garment as claimed in claim 1, wherein said pull member comprises a strap.

3. A protective garment as claimed in claim 1, wherein said pull member is attached to said front collar portion adjacent a side thereof.

4. A protective garment as claimed in claim 2, wherein said pull member is connected to said front portion by a loop secured to said front portion through which said strap passes.

5. A protective garment as claimed in claim 4, wherein said pull member is connected to said over blast protector by a loop secured to said over blast protector through which said strap further passes.

6. A protective garment as claimed in claim 5, further comprising a pull handle attached to an end of said pull member and sized larger than said look secured to said over blast protector to prevent said pull member from passing through said loop secured to said over blast protector.

7. A protective garment comprising a torso portion having front, back and side portions, a blast plate holder separate from the torso portion, a first fastening means for releasably attaching the holder to the front of said torso portion, a first pull member including a first strap attached to said holder for enabling said holder to be released from said torso portion by pulling on said pull member, a front and rear collar portion having a second fastening means for releasably connecting said front portion of said collar to said rear portion of the collar, and a second pull member including a second strap having a first end attached to the front portion of said collar for releasing the front portion from the rear portion of said collar and a second end attached to said first pull member such that said first pull member can release both the front portion of said collar from the rear portion thereof and release said holder from said torso portion by pulling thereon.

8. A protective garment as claimed in claim 7, wherein said second fastening means comprises a first coupling for fastening said holder at one side of said torso portion and a second coupling means for fastening said holder at the other side of said torso portion.

* * * * *